US006497535B1

(12) United States Patent
Thomas

(10) Patent No.: US 6,497,535 B1
(45) Date of Patent: Dec. 24, 2002

(54) MATERIAL DISTRIBUTION VESSEL AND METHOD FOR DISTRIBUTING MATERIAL RECOVERED IN A DREDGING OPERATION

(75) Inventor: Dennis R. Thomas, Peoria, IL (US)

(73) Assignee: Kress Corporation, Brimfield, IL (US)

( * ) Notice: Subject to any disclaimer, the term of this patent is extended or adjusted under 35 U.S.C. 154(b) by 0 days.

(21) Appl. No.: 09/486,322

(22) PCT Filed: Jul. 28, 1999

(86) PCT No.: PCT/US99/17111

§ 371 (c)(1),
(2), (4) Date: Feb. 24, 2000

(87) PCT Pub. No.: WO00/06841

PCT Pub. Date: Feb. 10, 2000

Related U.S. Application Data

(60) Provisional application No. 60/102,654, filed on Oct. 1, 1998, provisional application No. 60/098,160, filed on Aug. 27, 1998, provisional application No. 60/095,797, filed on Aug. 7, 1998, provisional application No. 60/094,633, filed on Jul. 30, 1998, and provisional application No. 60/094,378, filed on Jul. 28, 1998.

(51) Int. Cl.[7] ..... E02F 9/06; E02F 7/02

(52) U.S. Cl. ..... 405/222; 405/117; 405/195.1; 114/34; 414/140.9; 414/142.2

(58) Field of Search ..... 405/15, 16, 17, 405/107, 116, 117, 195.1, 222; 114/26, 27, 31, 34; 414/140.8, 140.9, 142.1, 142.2, 142.4; 37/345, 346, 337, 338, 341

(56) References Cited

U.S. PATENT DOCUMENTS

| | | | | |
|---|---|---|---|---|
| 808,800 A | * | 1/1906 | Wright | 405/116 |
| 1,153,851 A | * | 9/1915 | Menzies | 405/107 |
| 1,196,426 A | | 8/1916 | Bowling | |
| 1,249,555 A | | 12/1917 | Townsend | |
| 1,460,558 A | | 7/1923 | Olden | |
| 1,839,929 A | | 1/1932 | Powell | |
| 2,309,715 A | * | 2/1943 | Rudow | 414/140.9 |
| 2,731,741 A | | 1/1956 | Kaufmann | 37/54 |
| 3,086,305 A | * | 4/1963 | West | 37/346 |

(List continued on next page.)

FOREIGN PATENT DOCUMENTS

| | | |
|---|---|---|
| FR | 2 580 693 | 4/1985 |
| GB | 1 538 389 | 1/1979 |
| JP | 56039988 | 4/1981 |

(List continued on next page.)

OTHER PUBLICATIONS

Full English Translation of Okawa et al., Japanese Patent No. JP 04106228A, Publication Date Apr. 8, 1992.

(List continued on next page.)

*Primary Examiner*—Frederick L. Lagman
(74) *Attorney, Agent, or Firm*—Marshall, Gerstein & Borun

(57) ABSTRACT

A material distribution vessel for distributing material recovered in a dredging operation is disclosed. The material distribution vessel includes a hull; a propulsion system for selectively moving the hull through a waterway; and a conveyor system supported by the hull. The conveyor system has a first end for receiving recovered material and a second end for depositing the recovered material. At least a portion of the conveyor system is movable relative to the hull to move the second end to a desired position. The material distribution vessel also includes at least one support pad. The at least one support pad is movable in at least a vertical direction to support the hull on a bottom of the waterway. The recovered material may be deposited into the waterway to form an island (which may be a levy), into another water-borne vessel, or into an on-shore station such as a wheeled transportation vehicle.

10 Claims, 23 Drawing Sheets

U.S. PATENT DOCUMENTS

| | | | | | |
|---|---|---|---|---|---|
| 3,313,051 | A | | 4/1967 | Sova | 37/189 |
| 3,476,498 | A | | 11/1969 | Bolhar | 299/8 |
| 3,578,186 | A | | 5/1971 | Thomas | 214/83.22 |
| 3,640,238 | A | | 2/1972 | Stockable | 114/235 A |
| 3,650,238 | A | | 3/1972 | Stockdale | 114/235 R |
| 3,690,023 | A | | 9/1972 | Peterson | 37/90 |
| 3,782,317 | A | | 1/1974 | Kriedt et al. | 114/52 |
| 3,783,626 | A | | 1/1974 | Hansen | 61/46.5 |
| 3,845,631 | A | * | 11/1974 | Malan | 405/222 |
| 4,070,978 | A | | 1/1978 | Virgilio | 114/26 |
| 4,162,584 | A | | 7/1979 | Satterwhite | 37/190 |
| 4,214,387 | A | | 7/1980 | Boehme et al. | 37/195 |
| 4,257,178 | A | | 3/1981 | Spradlin | 37/70 |
| 4,397,587 | A | * | 8/1983 | Op Den Velde et al. | 405/222 |
| 4,412,587 | A | | 11/1983 | van der Lely | 172/39 |
| 4,483,655 | A | | 11/1984 | Snow et al. | 414/786 |
| 4,592,155 | A | * | 6/1986 | Mustonen | 37/54 |
| 4,702,023 | A | | 10/1987 | McDowen | 37/66 |
| 4,713,896 | A | | 12/1987 | Jennens | 37/54 |
| 5,049,021 | A | | 9/1991 | Pole et al. | 414/141.9 |
| 5,058,294 | A | | 10/1991 | Bryan, Jr. | 37/190 |
| 5,115,751 | A | | 5/1992 | Copson | 114/27 |
| 5,311,682 | A | | 5/1994 | Sturdivant | 37/312 |
| 5,404,696 | A | | 4/1995 | Vasby | 56/9 |
| 5,456,551 | A | | 10/1995 | Saxon | 405/163 |
| 5,479,869 | A | | 1/1996 | Coudon et al. | 114/26 |
| 5,490,339 | A | | 2/1996 | Accettola | 37/94 |
| 5,573,363 | A | * | 11/1996 | Rohr | 414/140.9 |
| 5,638,620 | A | | 6/1997 | Van Der Kooy | 37/338 |
| 5,642,684 | A | | 7/1997 | Aker | 114/151 |
| 5,853,264 | A | * | 12/1998 | Treveloni | 405/17 |
| 5,903,989 | A | | 5/1999 | Satzler | 37/353 |
| 5,907,915 | A | | 6/1999 | Satzler | 37/337 |
| 5,960,570 | A | | 10/1999 | Satzler | 37/337 |

FOREIGN PATENT DOCUMENTS

| | | |
|---|---|---|
| JP | 61053921 | 3/1986 |
| JP | 62004695 | 1/1987 |
| JP | 04106228 | 4/1992 |
| JP | 05339930 | 12/1993 |
| JP | 10018345 | 1/1998 |
| WO | WO 95/21303 | 8/1995 |
| WO | WO 98/44204 | 8/1998 |

OTHER PUBLICATIONS

Full English Translation of Omiya et al., Japanese Patent No. JP 410018345A, Publication Date Jan. 20, 1998.

Full English Translation of Akio, Japanese Patent No. JP 61–53921, Publication Date Mar. 18, 1996.

*Written Opinion* concerning International Application Ser. No. PCT/US99/17111, European Patent Office, dated Jun. 15, 2000, 9 pages.

*International Search Report* concerning International Application Ser. No. PCT/US99/17111, European Patent Office, dated Nov. 3, 1999, 7 pages.

* cited by examiner

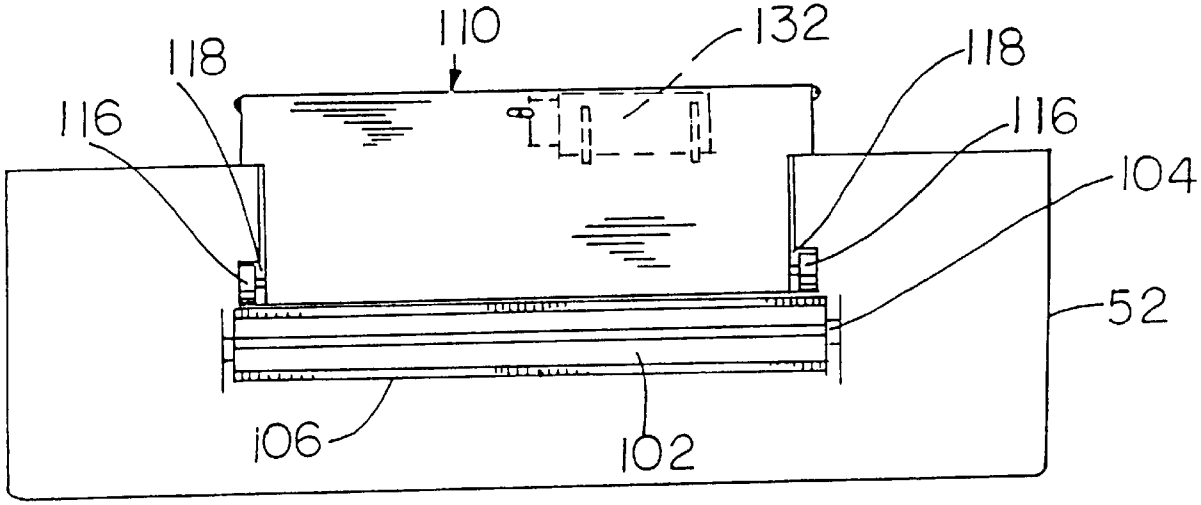
FIG. 12
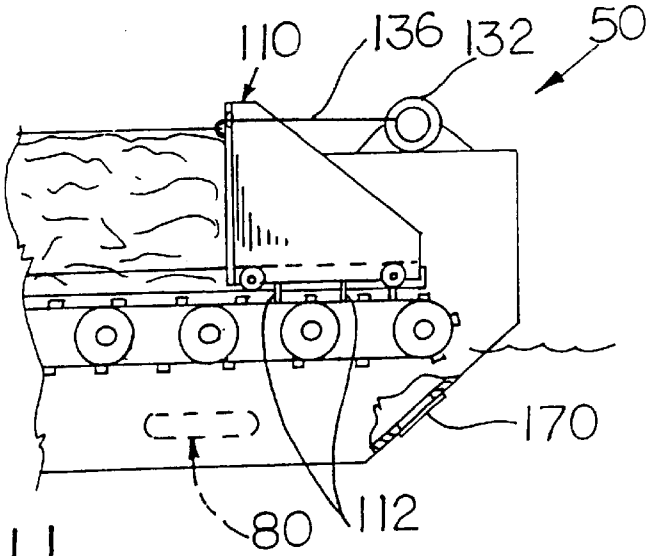
FIG. 11
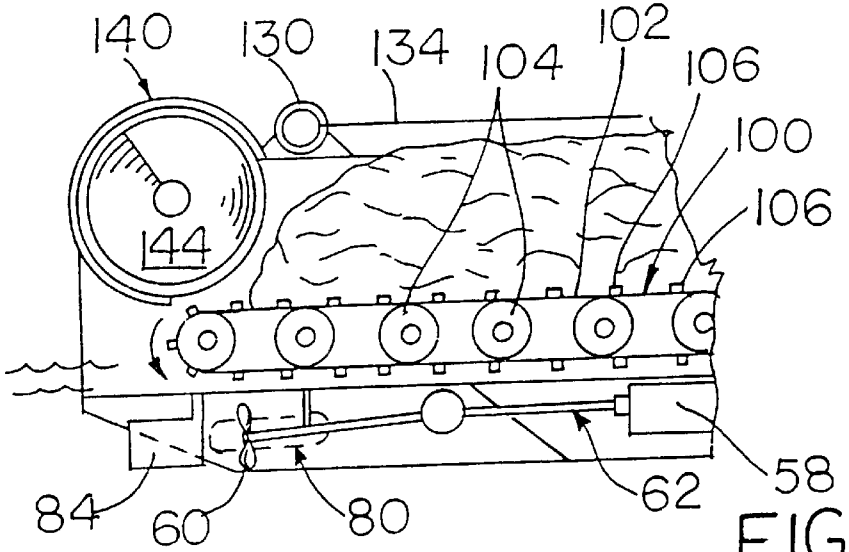

MATERIAL DISTRIBUTION VESSEL AND METHOD FOR DISTRIBUTING MATERIAL RECOVERED IN A DREDGING OPERATION

RELATED APPLICATIONS

This patent claims the benefit of U.S. Provisional Application Serial No. 60/094,378, filed Jul. 28, 1998, U.S. Provisional Application Serial No. 60/094,633, filed Jul. 30, 1998, U.S. Provisional Application Serial No. 60/095,797, filed Aug. 7, 1998, U.S. Provisional Application Serial No. 60/098,160, filed Aug. 27, 1998, and U.S. Provisional Application Serial No. 60/102,654, filed Oct. 1, 1998.

FIELD OF THE INVENTION

The invention relates generally to dredging, and, more particularly, to a material distribution vessel and a method for distributing material recovered in a dredging operation.

BACKGROUND OF THE INVENTION

Due largely to erosion, the waterways of many areas of the world are becoming choked with silt and the like. As the waterways become more and more shallow, certain problems arise. For example, navigation through the waterways becomes difficult or altogether impossible. In addition, the risk of flooding adjoining areas of a waterway increases as the depth of the waterway decreases.

Over the years, many dredging techniques have been devised. Perhaps the most popular dredging technique involves a vacuuming dredge which sucks silt and the like from the bottom of the waterway through a conduit or a hose. This technique is disadvantageous in several respects. For example, it collects large volumes of water in the dredging process. As a result, the material recovered by this dredging technique is largely a liquid mixture that is difficult to handle and dispose of. By way of another example, the vacuuming technique mentioned above tends to disturb the bed of the waterway in a manner that mixes silt and impurities imbedded in the silt into the water. Some of these impurities may be toxic (e.g., lead and mercury). Dredging with this old technique can, therefore, pose an environmental hazard. Due to these and other difficulties, dredging a waterway using the vacuuming technique is an expensive, time-consuming and hazardous proposition.

Recently, Caterpillar® has invented a new dredging assembly. The dredging assembly is a large wheel that rolls along and slices into the bed of a waterway. The wheel is compartmentalized by slicing blades that slice and pick-up segments of the bed of the waterway as the wheel turns in a fashion similar to a cookie cutter slicing cookies from dough. The development of this new dredging technology has made it possible to dredge waterways in a much more efficient, cost-effective manner. Specifically, because the dredging wheel lifts large segments of silt from the waterway bed, the material it recovers is largely solid and undisturbed, is not mixed with much (if any) additional water during dredging, and, thus, can be more efficiently handled than material recovered by the prior art vacuuming system discussed above.

While the development of the Caterpillar® dredging wheel offers a significant opportunity to recover material from the waterways of the world and to restore those waterways to navigable depths, it has also given rise to a new set of technological problems from the material handling perspective. Specifically, now that it is possible to quickly dredge large volumes of substantially solid material from a waterway, it is necessary to develop apparatus and systems for handling, transporting and/or disposing of the material recovered by the dredge.

SUMMARY OF THE INVENTION

In accordance with an aspect of the invention, a method is disclosed for constructing an island in a waterway with material recovered in a dredging operation. The method comprises the step of positioning a material distribution vessel at a first island building area in a waterway. The methods also includes the steps of: supplying a conveyor system of the material distribution vessel with recovered material; depositing the recovered material from the conveyor system into the waterway at a first location in the waterway; moving at least a portion of the conveyor system by at least one of slewing, retracting and extending the at least a portion of the conveyor system; and depositing the recovered material from the conveyor system into the waterway at a second location in the waterway. The first and second locations are located within the first island building area.

In accordance with another aspect of the invention, a material distribution vessel is disclosed for distributing material recovered in a dredging operation. The material distribution vessel comprises a hull; a propulsion system for selectively moving the hull through a waterway; and a conveyor system supported by the hull. The conveyor system has a first end for receiving recovered material and a second end for depositing the recovered material. At least a portion of the conveyor system is movable relative to the hull to move the second end to a desired position. The material distribution vessel also includes at least one support pad. The at least one support pad is movable in at least a vertical direction to support the hull on a bottom of the waterway.

Other features and advantages are inherent in the disclosed apparatus or will become apparent to those skilled in the art from the following detailed description and its accompanying drawings.

BRIEF DESCRIPTION OF THE DRAWINGS

FIG. 11 is a partial cross-sectional side view of the vessel of FIG. 5.

FIG. 12 is a cross sectional view of the vessel of FIG. 5 taken along lines 12—12 of FIG. 7.

DESCRIPTION OF THE PREFERRED EMBODIMENTS

Figure 1:
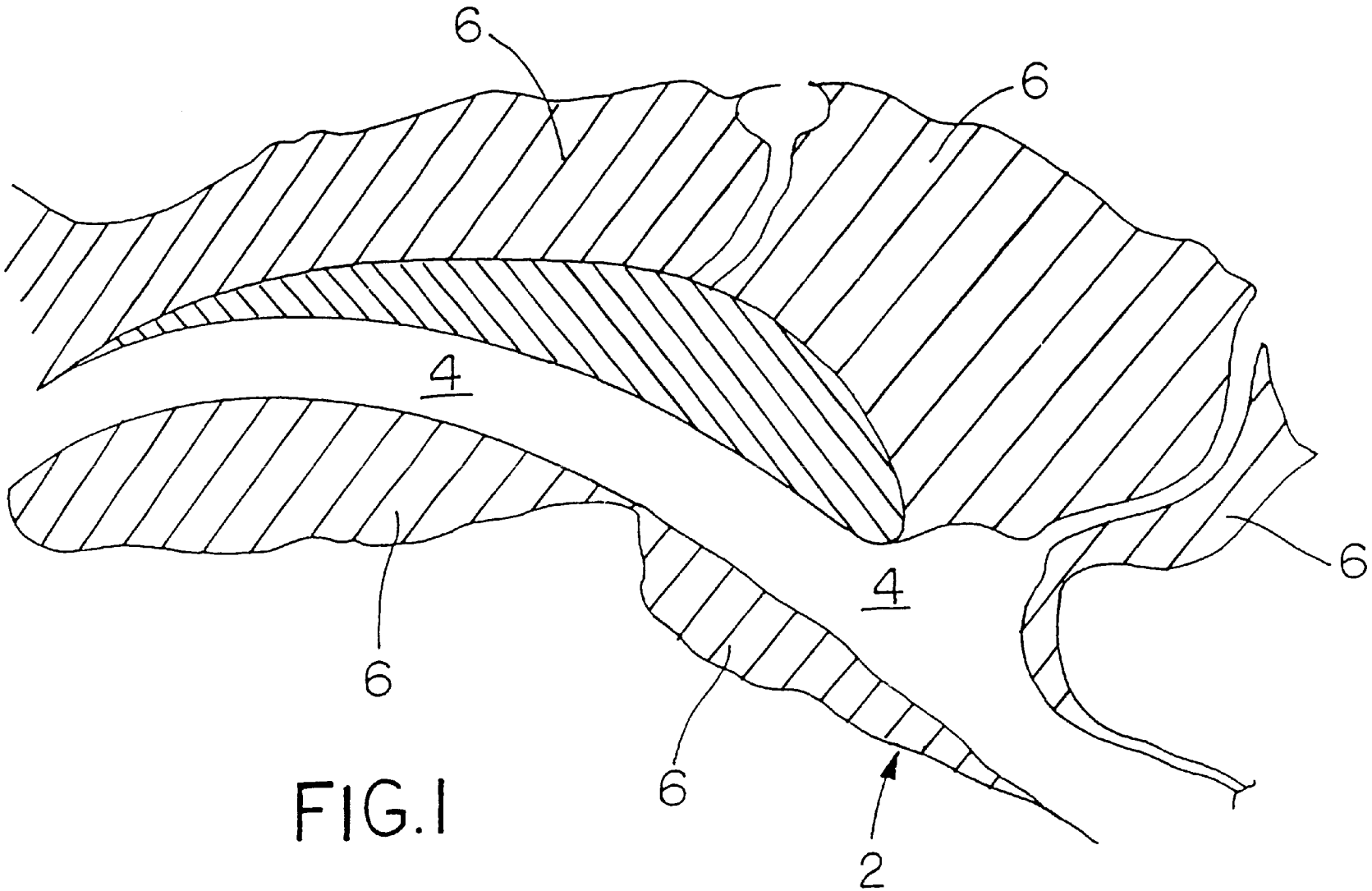
FIG. 1 is an illustration of an exemplary environment of use for the disclosed methods and vessels.

In the following description and drawings, like reference numerals are generally used to refer to like structures. With the exception of the dredging vessel 10, in the case of different vessels having similar structures, whenever possible the last two digits of reference numerals referring to similar structures are identical. Thus, for example, the hull of the vessel 50 is labeled with reference numeral "52" and the hull of the vessel 300 is labeled with reference numeral "352". While this nomenclature has been used for ease of understanding, it is not intended to suggest identity between corresponding structures in different vessels unless exactly the same reference numeral is employed to refer to the corresponding structures in both vessels.

A portion of a river 2 is shown in FIG. 1. The illustrated river 2 is exemplary of many rivers of the world in that it includes a main channel 4 through which vessels such as barges pass and shallower areas 6 around the channel 4 wherein at best only smaller, low draft vessels can pass. Both the main channel 4 and the surrounding areas 6 are shallower than their historic levels due to erosion.

A. Exemplary Dredging Vessel

Figure 2:
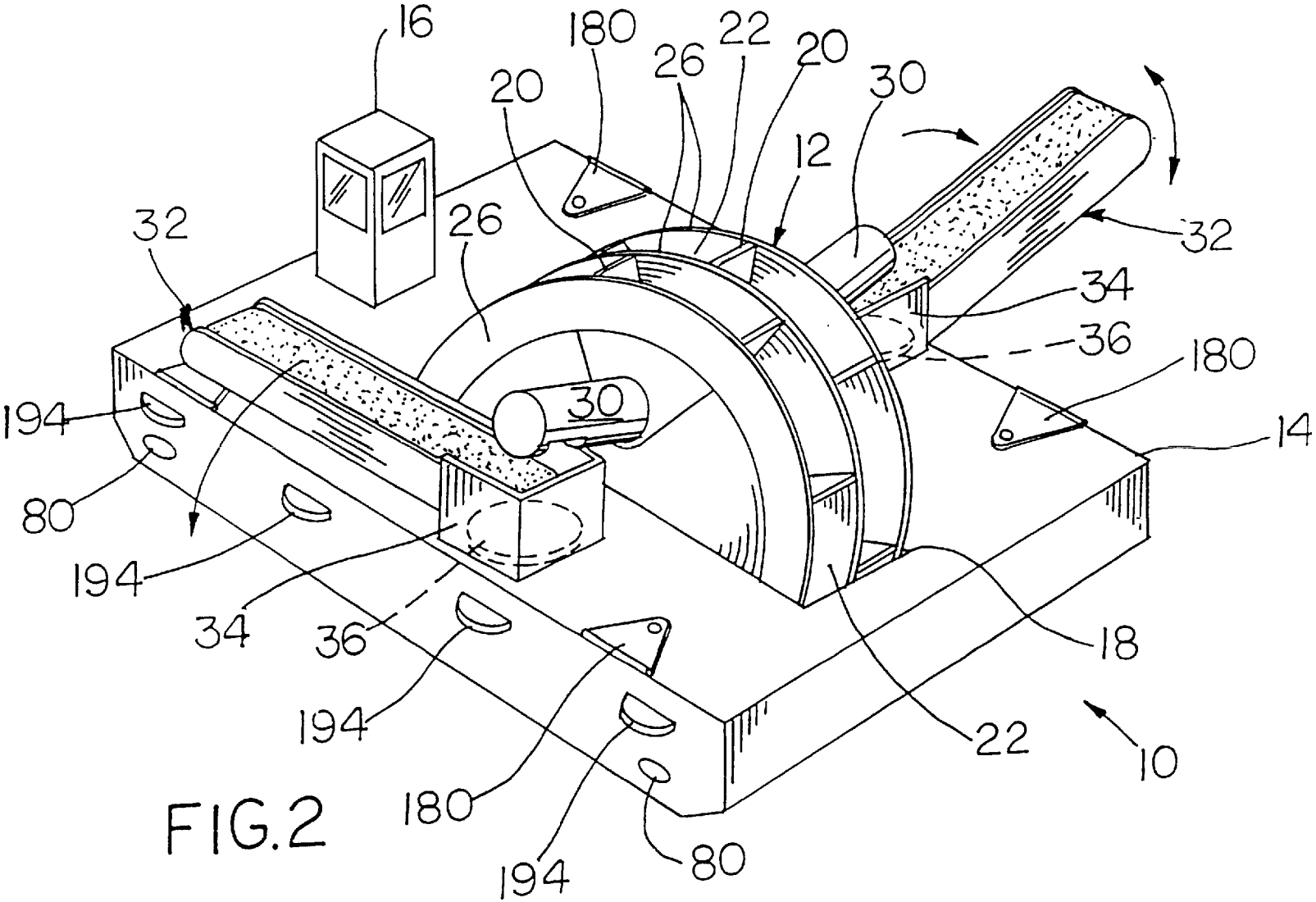
FIG. 2 is a right, front perspective view of an exemplary dredging vessel.

As mentioned above, Caterpillar® has developed a dredging wheel that can be used to rapidly dredge large amounts of solid material from the bottom of a waterway such as the river shown in FIG. 1. An exemplary dredging vessel 10 incorporating the Caterpillar® dredging wheel 12 is shown in FIG. 2. The dredging vessel 10 includes a hull 14 which is designed with a low draft for operation in shallow water. The hull 14 is powered by a propulsion system (not shown) which is controlled by an operator located in a cab 16 in a conventional manner. The dredging wheel 12 is located in a well or aperture 18 which is formed generally centrally relative to the hull 14. The wheel 12 is supported by hydraulic jacks 19 (See FIGS. 3–4) or the like which can be powered to raise or lower the dredging wheel 12 to a desired depth for dredging or transport.

For the purpose of capturing material to be dredged from the bed of the waterway (hereinafter "recovered material"), the dredging wheel 12 is provided with a number of generally evenly spaced blades 20. The blades 20 divide the outer perimeter of the dredging wheel 12 into a plurality of capture cavities 22. Two blades 20 form two, oppositely disposed sides of each capture cavity 22. The other two opposite sides of the cavities 22 are formed by generally parallel, circular wheel plates 26. The top and bottom of each capture cavity 22 are open.

Figure 3:
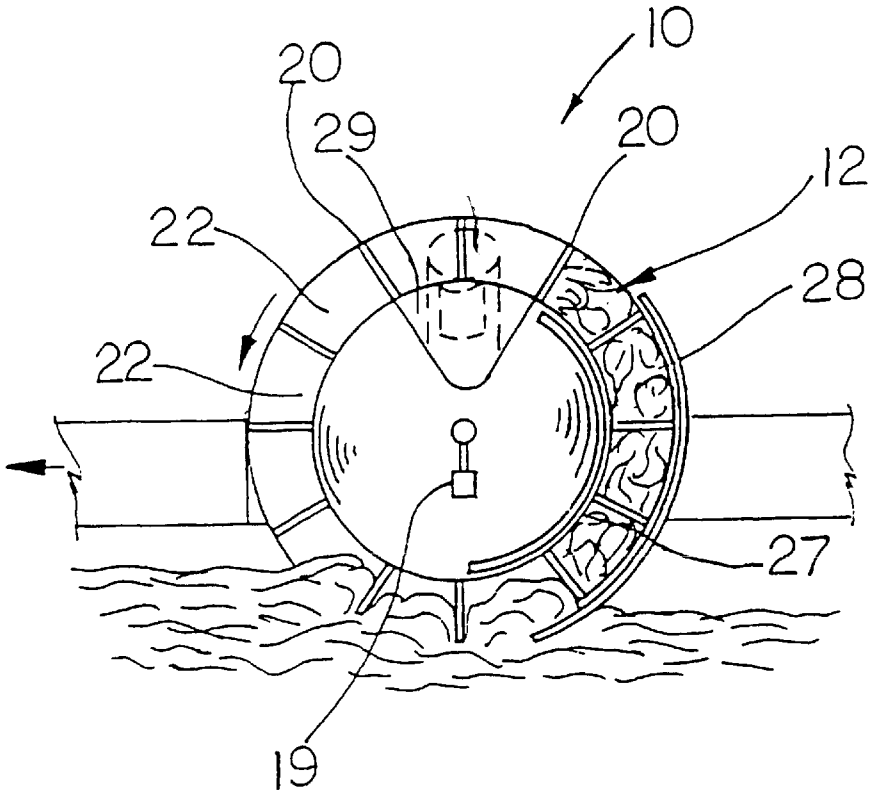
FIG. 3 is a partial, cut-away side view of the dredging wheel of the dredging vessel of FIG. 2 in a first state of operation.

In operation, as the dredging vessel 10 moves forward, the dredging wheel 12 rotates such that a capture cavity 22 digs into the waterway bottom and collects a slab of material to be dredged (See FIG. 3). As the wheel 12 continues to rotate, the filled capture cavity 22 rotates between an inner capture plate 27 and an outer capture plate 28 formed at the back of the wheel 12. (The outer capture plate 28 is not shown in FIG. 2 to provide a better view of the capture cavities 22.) The capture plates 27, 28 seal the top and bottom openings of the capture cavity 22 to ensure the recovered material remains in the cavity 22 as the cavity 22 rotates toward the top of the wheel 12. As the filled capture cavity 22 reaches the top of the wheel 12, the inner capture plate 27 terminates such that, when the filled cavity 22 reaches the top of the wheel 12, the dredged material falls out of the capture cavity 22 under the influence of gravity (and, optionally, under the influence of a mechanical assist (not shown)) and into a hopper 29 in the center of the wheel 12.

Figure 15:
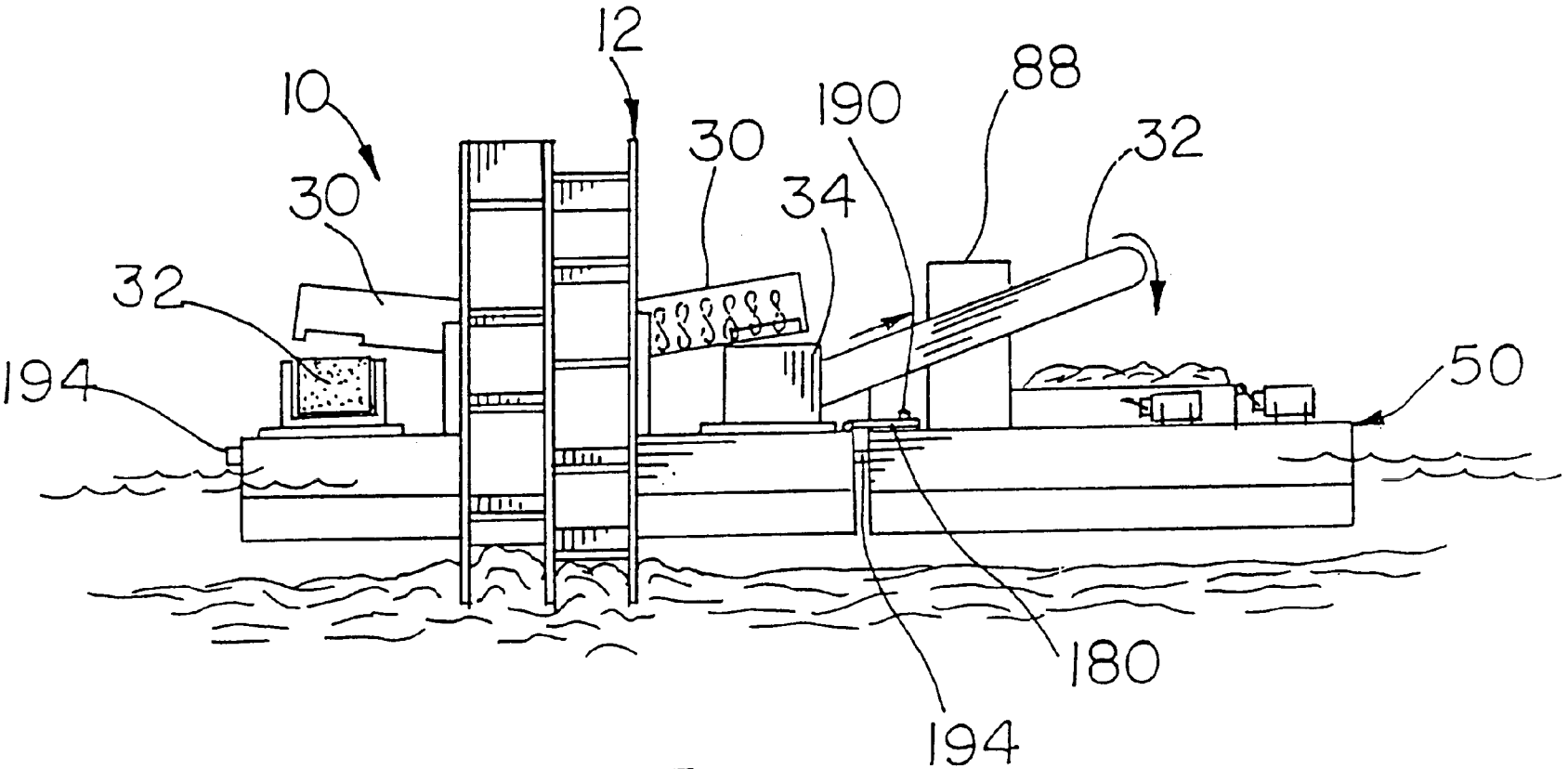
FIG. 15 is a side view of the dredging vessel of FIG. 2 loading the material transportation vessel of FIG. 5.

As shown in FIG. 2, the hopper 29 is serviced by two, oppositely disposed augers 30 which function independently to discharge the recovered material from the hopper 29 at the center of the wheel 12. For the purpose of off-loading material from the dredging vessel 10, the dredging vessel 10 is further provided with rotatable conveyors 32. As shown in FIG. 2, each of the conveyors 32 extends into a receiving box 34 mounted beneath a respective one of the augers 30 of the dredging wheel 12. The receiving boxes 34 act as guides to ensure the dredged material dropped by the corresponding auger 30 stays on the corresponding conveyor 32. As shown in FIG. 15, the conveyors 32 are preferably upwardly inclined to facilitate loading into an adjacent vessel.

Each of the conveyors 32 is supported within its receiving box 34 upon a turret 36 of conventional design. Each turret 36 permits the corresponding receiving box 34 and conveyor 32 to rotate approximately 180°. Persons of ordinary skill in the art will readily appreciate that both the turrets 36 and the belts of the conveyors 32 can be driven in many ways without departing from the scope or spirit of the invention. By way of examples, not limitations, the conveyor belts and/or the turrets 36 can be driven by electrical motors or hydraulic motors.

Additional details concerning the structure and function of the Caterpillar® dredging wheel 12 can be found in Satzler, U.S. Pat. No. 5,903,989, Satzler, U.S. Pat. No. 5,907,915, and U.S. patent application Ser. No. 08/834,676 which are all hereby incorporated by reference in their entirety.

As persons of ordinary skill in the art will appreciate from the foregoing, the Caterpillar® dredging wheel 12 provides an efficient, cost effective means for dredging a waterway. By using the Caterpillar® wheel 12, a large volume of substantially solid silt and/or other material can be quickly removed from a bed of a waterway such as a river.

B. Material Transportation Vessel

For the purpose of transporting the material recovered in the dredging operation, the applicants have developed a water-borne material distribution vessel 300 and a water-borne material transportation vessel 50 for transporting recovered material from the dredging vessel 10 to the material distribution vessel 300. The structure and function of representative examples of each of these vessels 50, 300 is fully disclosed below. However, before reaching that discussion, it must be noted that, although in the preferred implementation, the disclosed vessels 50, 300 are operated together to form a system for transporting recovered material, the vessels 50, 300 can be operated alone or in combination with different types of vessels and/or other structures without departing from the scope or spirit of the invention. Similarly, although in the presently preferred implementation, the vessels 50, 300 are operated in support of a dredging vessel employing the Caterpillar® dredging wheel 12, the vessels 50, 300 can be used with other types of dredges without departing from the scope or spirit of the invention.

Turning to the material transportation vessel 50 shown in FIGS. 5–14, for the purpose of entering shallow water, the vessel 50 is provided with a low draft hull 52. In particular, the surface area of the bottom of the hull 52 is preferably selected to ensure the vessel 50 has a draft of about four feet of water when fully loaded and a draft of about 12 inches when empty. Of course, other drafts can be selected without departing from the scope or spirt of the invention.

Figure 5:
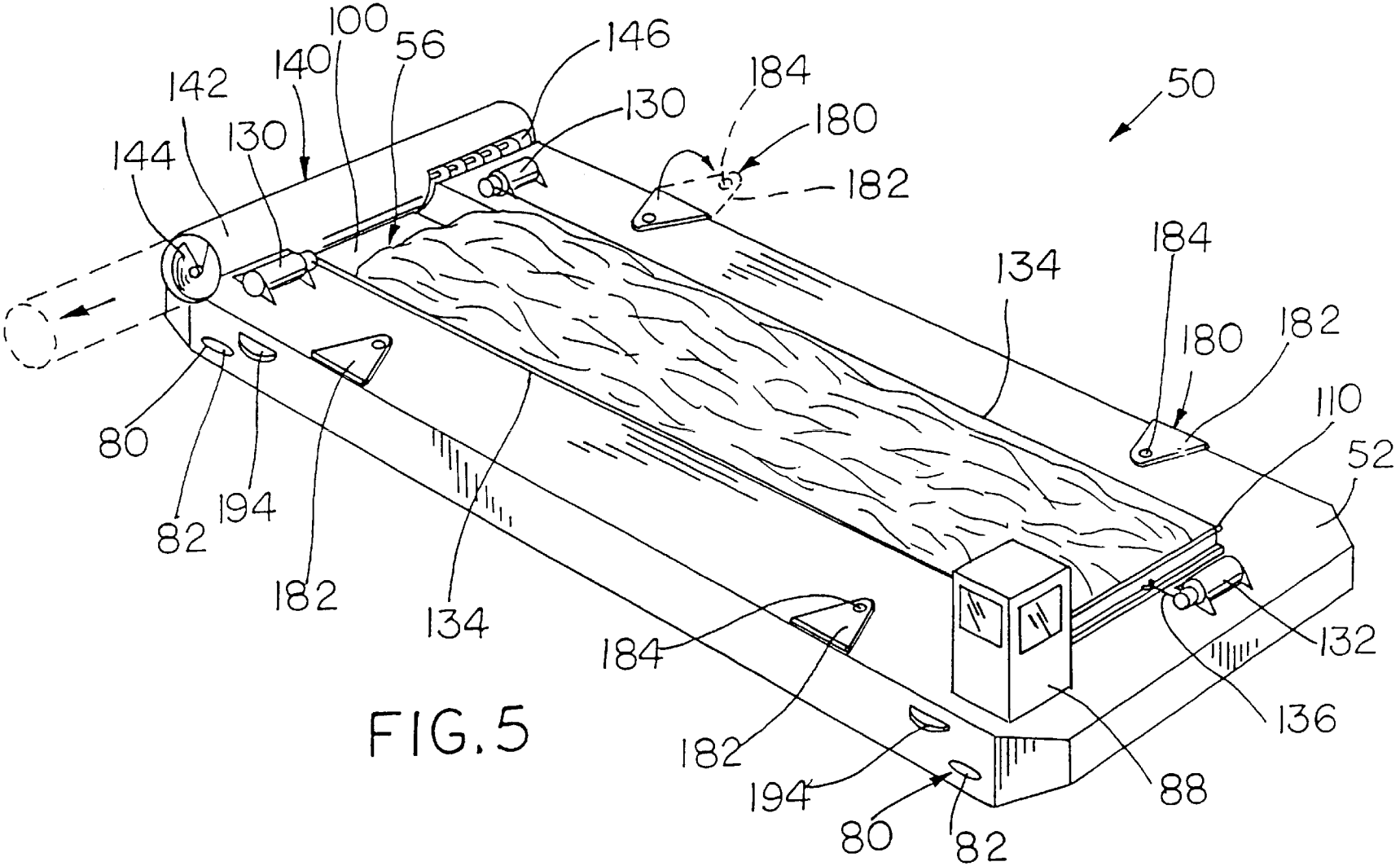
FIG. 5 is a right, front perspective view of a vessel constructed in accordance with the teachings of the invention for transporting and off-loading material recovered in a dredging operation.
Figure 6:
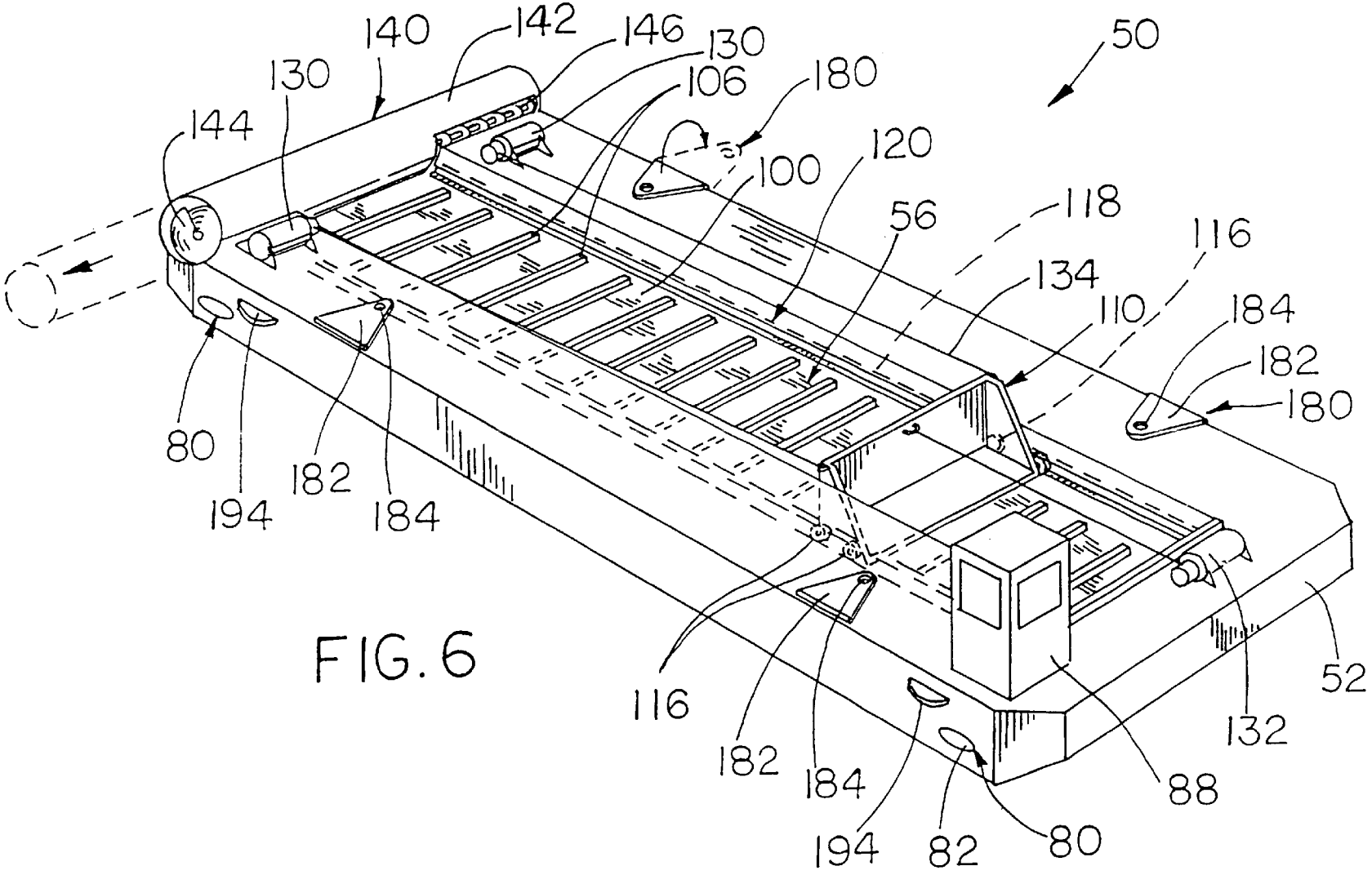
FIG. 6 is a view similar to FIG. 5, but showing the material transportation vessel with an empty hopper and a partially advanced ejector blade.
Figure 7:
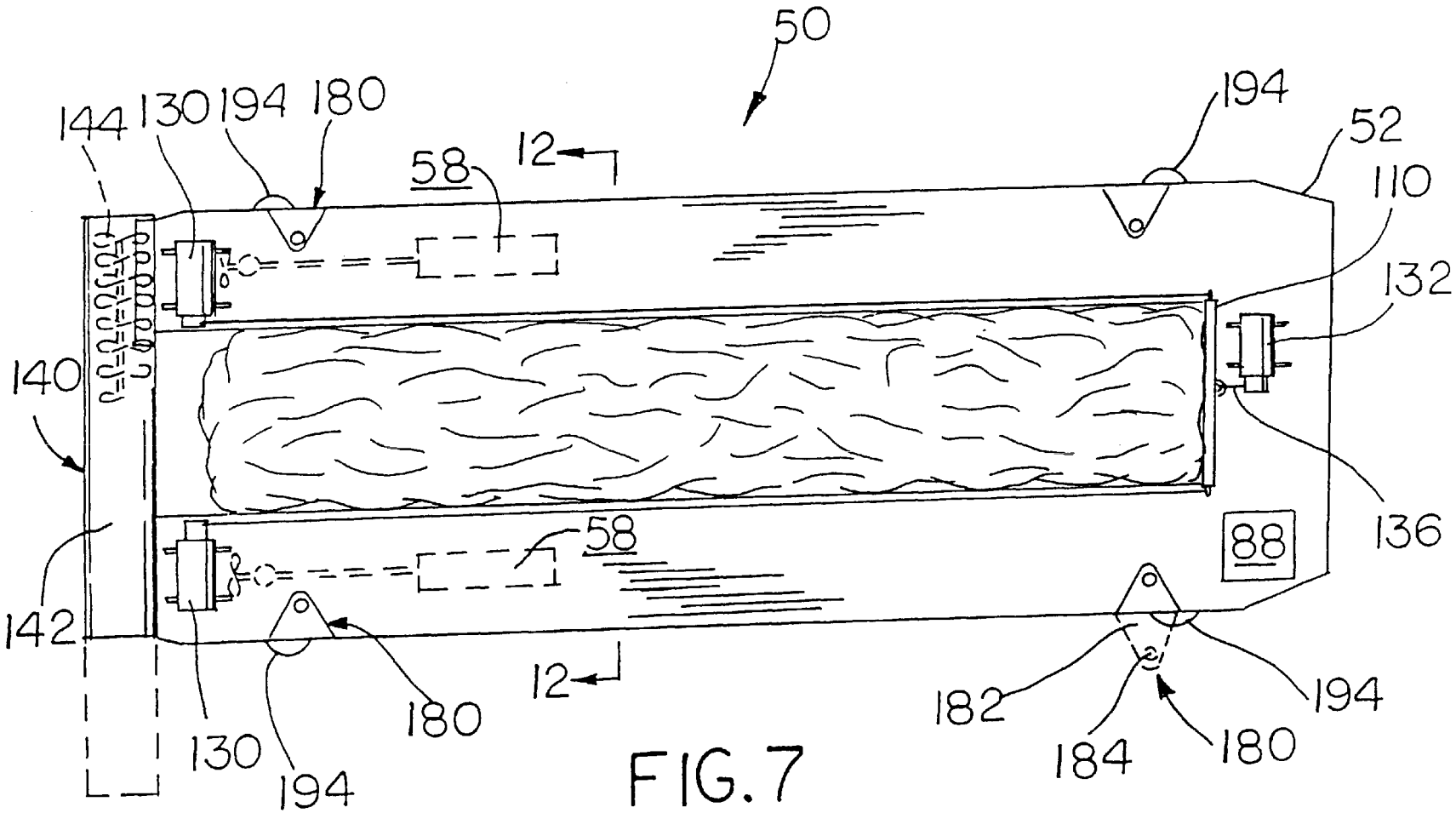
FIG. 7 is a top view of the vessel of FIG. 5.
Figure 8:
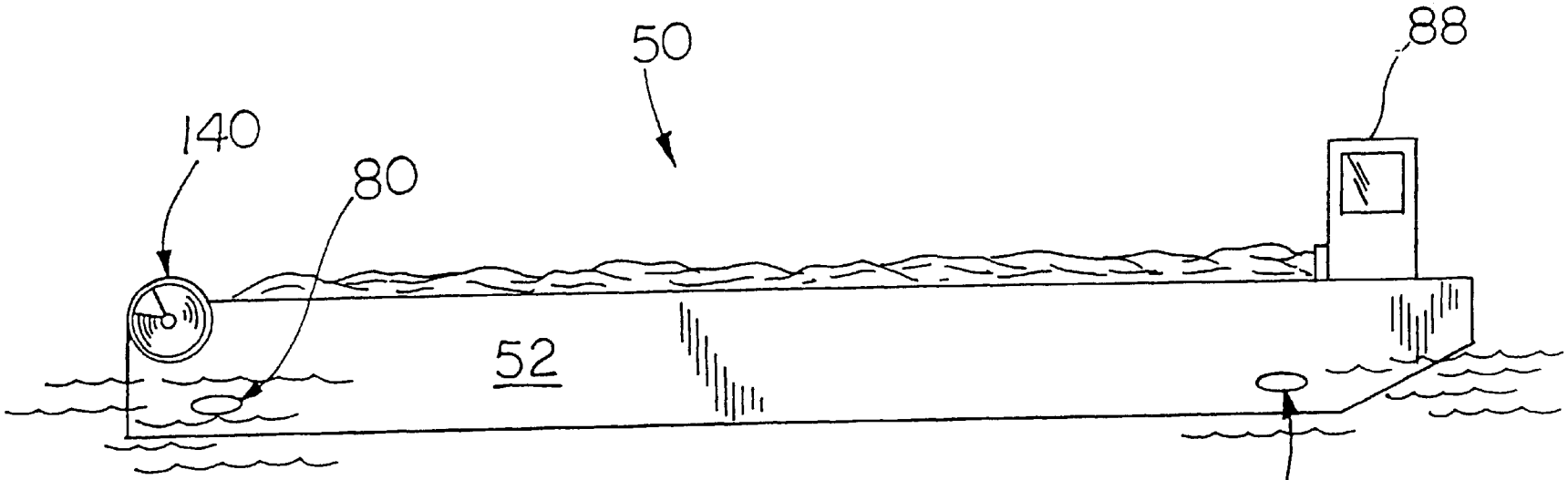
FIG. 8 is a right side view of the vessel of FIG. 5.

To provide a storage area for recovered material, the material transportation vessel 50 is further provided with a hopper 56. As shown in FIGS. 5–7, the hopper 56 is preferably rectangular in shape, is preferably substantially centered with respect to the hull 52, and preferably extends for most of the length of the hull 52. However, persons or ordinary skill in the art will readily appreciate that hoppers of other shapes, sizes and locations can be utilized without departing from the scope or spirit of the invention. In any event, the size of the hopper 56 is preferably selected along with the hull dimensions to provide a desired payload capacity within the draft preferences mentioned above.

For the purpose of moving the material transportation vessel 50 through a waterway, the vessel 50 is preferably provided with a propulsion system. Although persons of ordinary skill in the art will readily appreciate that the propulsion system can be implemented in many ways without departing from the scope or spirit of the invention, in the illustrated example, the propulsion system is implemented by twin, counter-rotating diesel engines 58 of conventional design (see FIG. 7). As most easily seen in FIG. 9, each of the engines 58 is operatively coupled to a large diameter propeller 60 via a drive shaft 62 in a conventional manner. Large diameter propellers 60 are employed to provide enhanced control during low velocity operation.

Because the material transportation vessel 50 is designed to have a very low draft when empty, the propellers 60 are preferably height adjustable. In particular, as most easily seen in FIG. 9, each of the drive shafts 62 preferably includes at least two segments 64, 66 joined by a joint 68 such as a constant velocity joint or a universal joint. The proximal segments 64 of the drive shafts 62 are rotatably mounted within a low friction bearing 70 of conventional design. The bearing 70 is coupled to the hull 52 via a hydraulic cylinder 72 such that, by extending the cylinder 72, one can lower the propeller 60 a further distance beneath the hull 52 to ensure the propeller 60 is completely submerged when, for example, the hopper 56 is empty. Conversely, when the vessel 50 is loaded, the propeller 60 can be raised to avoid contact with the bed of the waterway in shallow water.

In order to enhance the maneuverability of the vessel 50, the vessel 50 is further provided with stern and bow thrusters 80 on each of its sides (see FIGS. 5–8). The side thrusters 80 are preferably implemented as low power water jets or impellers of conventional design. In other words, they are implemented by hydraulically or electrically driven impellers located in transverse tubes. As shown in FIG. 5, each of the transverse tubes preferably terminates in an oval outlet port 82 to ensure the thrusters create a fan-shaped water stream (as opposed to a circular water jet which might be less effective than the fan-shaped jet in shallow water). As will be appreciated by persons of ordinary skill in the art, the side thrusters 80 render the vessel 50 capable of sideways movement. Indeed, the thrusters 80 preferably enhance the maneuverability of the vessel 50 to such an extent that the vessel 50 can turn 180° within its own length.

Figure 9:
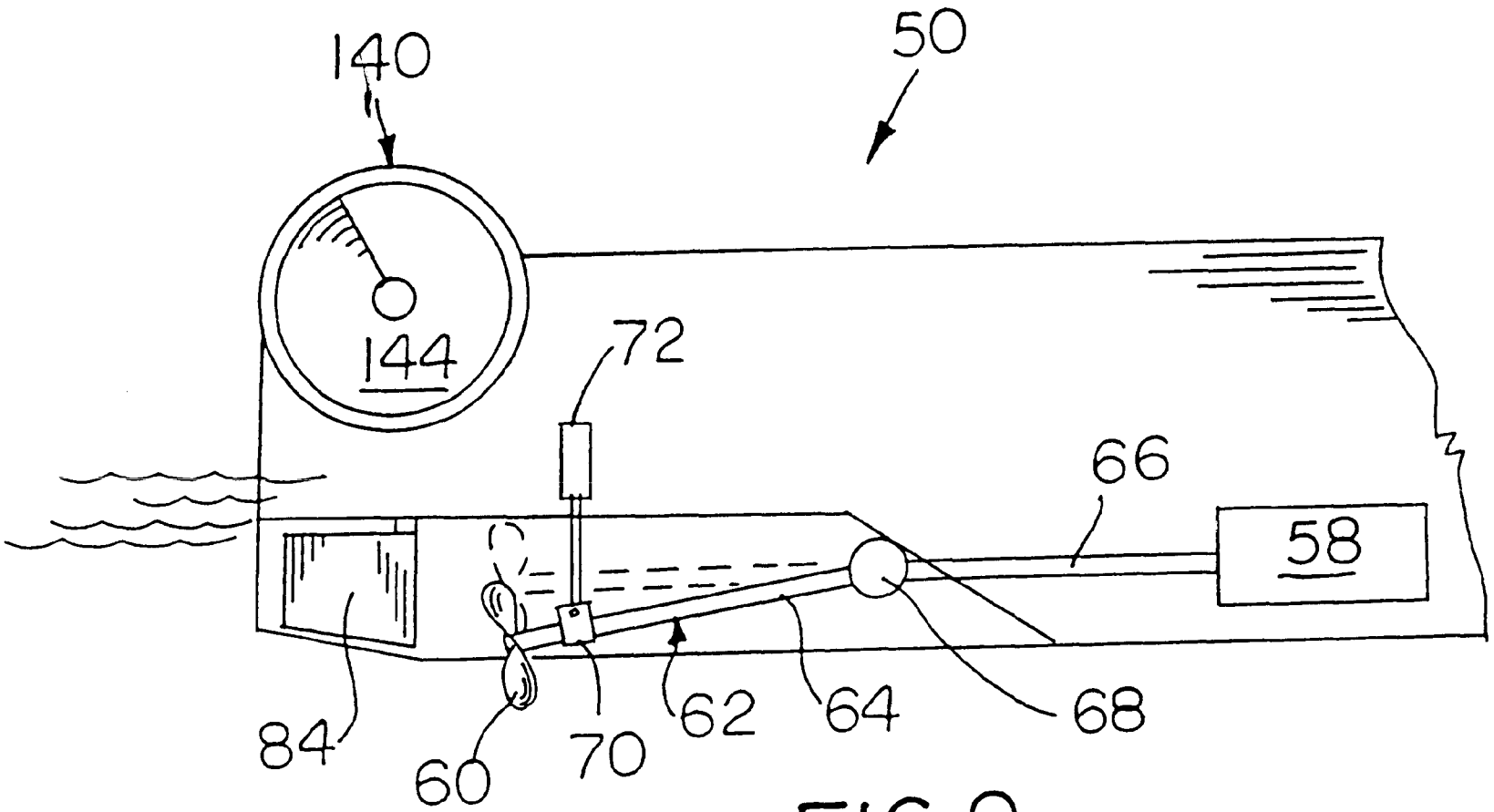
FIG. 9 is an enlarged view showing an exemplary propulsion system for the vessel of FIG. 5.

Of course, the vessel 50 is also provided with a rudder 84 of conventional design as shown in FIG. 9 to provide steerability apart from and, in addition to, the steerability provided by the side thrusters 80. The operation of the engines 58, the side thrusters 80, the rudder 84 and the various other systems of the vessel 50 are preferably controlled from a control panel located in a cab 88.

Figure 10:
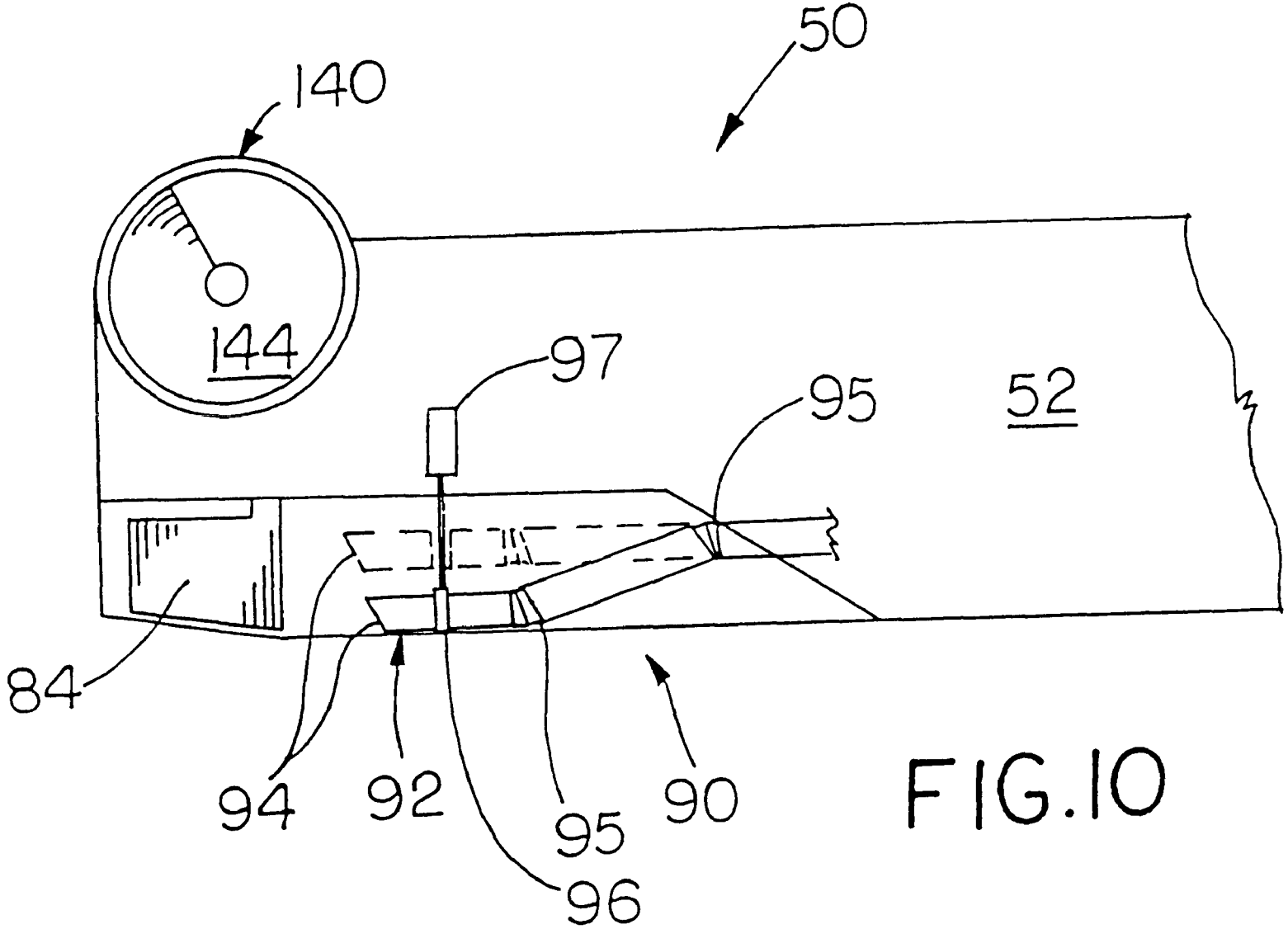
FIG. 10 is a view similar to FIG. 9 but showing an alternative propulsion system.

While as described above, twin engines 58 are preferred as the primary source of propulsion for the vessel 50, persons of ordinary skill in the art will appreciate that water jets could be used in place of the engines 58 without departing from the scope or spirit of the invention. An exemplary water jet 90 that can be used in this role is schematically illustrated in FIG. 10. As is conventional, the water jet 90 comprises a conduit 92 with an intake port (not shown) and an exhaust or discharge port 94. An electrically or hydraulically powered impeller (not shown) of conventional design is mounted within the conduit 92 and functions to draw water into the conduit 92 through the intake port and force it out of the conduit 92 through the exhaust port 93 to create a propulsion force in a direction opposite the flow of water out of the exhaust port 93. As with the side thrusters 80, the conduits 92 of the main water jets 90 are preferably transitioned into oval exhaust openings to thereby produce a fan-shaped water jet stream with a generally lower profile than a circular stream of the same cross-sectional area would have to facilitate use in shallow water.

Since, as mentioned above, the material transportation vessel 50 is preferably designed to have little draft, the conduit 92 of the water jet 90 is preferably provided with two joints 95 and the proximal end of the conduit 92 is preferably supported in a collar 96 connected to a hydraulic cylinder 97. By extending the cylinder 97, the vessel operator can lower the proximal end of the conduit 92 a further distance beneath the hull 52 to ensure the exhaust port 93 is completely submerged even when, for example, the hopper 56 is empty and the vessel 50 has very little draft. Conversely, when the vessel 50 is laden, the conduit 92 can be raised.

Persons of ordinary skill in the art will appreciate that, although in the illustrated example, the material transportation vessel 50 is primarily steered with a rudder 84 when using water jets 90 as its primary source of propulsion force, the rudder 84 could be replaced and/or augmented by making the proximal ends of the conduits 92 of the jets steerable without departing from the scope of the invention. In such an approach, the exhaust ports 93 of the conduits 92 can be pivoted or otherwise directed in a direction opposite the desired direction of movement to steer the vessel 50 through a waterway.

Although either water jets 90 or conventional engines 58 can be utilized as the primary propulsion source, conventional engines are presently preferred because they create less turbulence than water jets and are generally more cost effective.

For the purpose of loading and unloading the vessel 50, the hopper 56 is provided with a movable floor 100 (see FIG. 6). The movable floor 100 preferably extends over substantially the entire length and width of the hopper 56 and supports the material recovered in the dredging operation within the hopper 56. As most easily seen in FIG. 11, the movable floor 100 is preferably implemented by a conveyor belt 102 mounted upon a plurality of idler rollers 104 journalled between the side walls of the hopper 56. The idler rollers 104 are preferably mounted in low friction bearings (not shown) of conventional design and are closely spaced, but do not touch one another to minimize friction during movement of the floor 100.

The belt 102, which is preferably endless, is preferably implemented by commercially available conveyor belting material such as steel or nylon reinforced rubber. As shown in FIGS. 6 and 11, the belt 102 is also preferably provided with steel cleats 106 to reduce, and preferably prevent, slippage between the floor 100 and the recovered material the floor supports.

To facilitate ejection of the material recovered in the dredging operation from the vessel 50, the hopper 56 is further provided with an ejector blade 110 (see FIG. 6). As shown in FIG. 11, the ejector blade 110 is preferably secured to the belt 102 of the movable floor 100 with conventional fasteners 112 such as bolts or the like. The ejector blade 110 preferably extends the entire width of the hopper 56 and moves with the belt 102 to eject the dredged material from the hopper 56. In particular, like the cleats 106, the ejector blade 110 functions to prevent the floor 100 from slipping under the recovered material and, thus, ensures that the material is conveyed forward by the moving floor 100.

As most easily seen in FIGS. 6 and 12, in addition to being bolted to the floor 100, the ejector blade 110 is guided in its reciprocating movement through the hopper 56 by a track system. In particular, the ejector blade 110 is provided with guide rollers 116 mounted for rotational movement on each of its sides. The sides of the hopper 56, on the other hand, define oppositely disposed channels 118 which together form a track 120 which is sized to receive the wheels 116 of the ejector blade 110. The wheels 116 of the ejector blade 110 roll back and forth within the track 120 as the ejector blade 110 reciprocates through the hopper 56.

Figure 13:
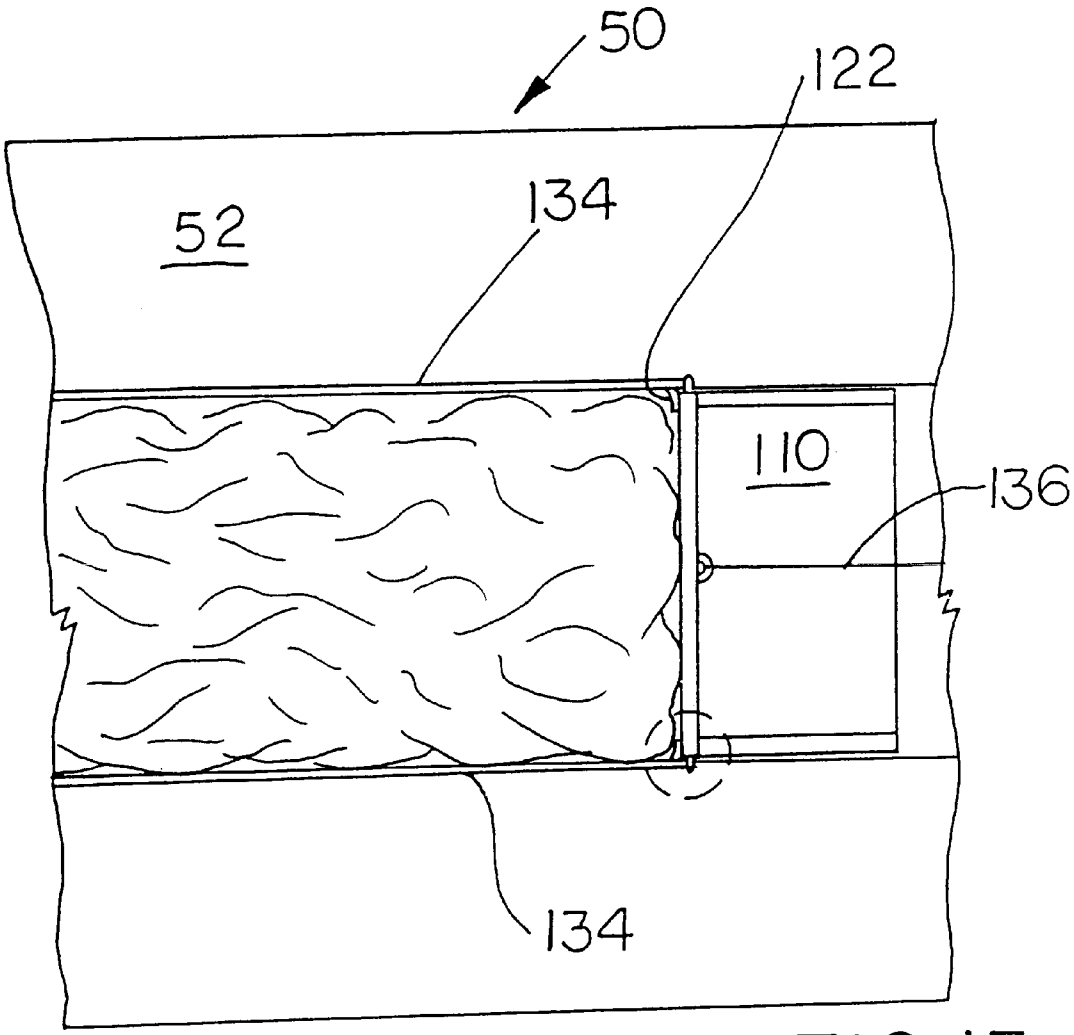
FIG. 13 is a partial top view of the vessel of FIG. 5 showing the ejector blade and floor of the hopper advancing to eject material from the hopper.
Figure 14:
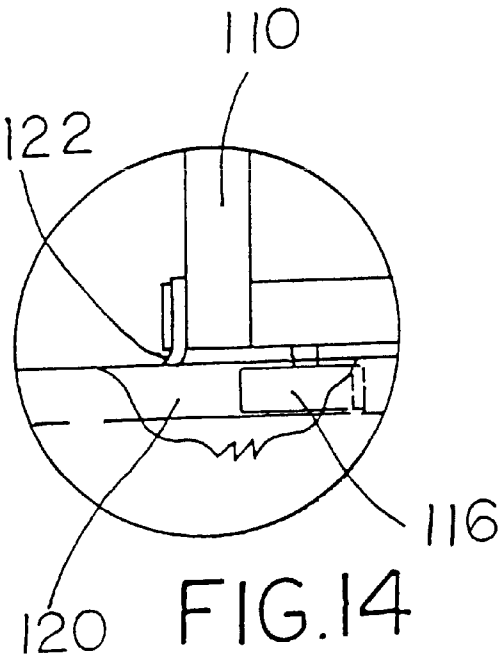
FIG. 14 is an enlarged view of the circled area of FIG. 13.

To prevent silt or other recovered material from interfering with the operation of the wheels 116, deflector plates (not shown) or the like are secured to the ejector blade 110 in front of the front-most wheels 116 to push any recovered material within the track 120 ahead of the rollers 116. Similarly, to prevent recovered material from passing between the sides of the hopper 56 and the ejector blade 110, the front edges of the ejector blade 110 are preferably provided with rubber-tipped wipers 122 that slide along the sides of the hopper 56 (see FIG. 13 and the enlargement of the circled portion of FIG. 13 shown in FIG. 14). Preferably, the wipers 122 wipe the sides of the hopper 56 substantially clean as the ejector blade 110 traverses the hopper 56 to eject the recovered material therefrom. Preferably, the channels 118 of the track 120 include openings which are in communication with the collection chamber 160 discussed below to ensure debris does not collect in the track 120.

For the purpose of driving the ejector blade 110 and the attached floor 100 through the hopper 56 to eject the recovered material therefrom, the material transportation vessel 50 is provided with a drive system. In the illustrated vessel 50, the drive system is implemented by a pair of ejection winches 130, a return winch 132 and corresponding cables 134, 136 coupled to the ejector blade 110. More specifically, as shown in FIGS. 5–7, an ejector winch 130 is mounted adjacent each side of the hopper 56 near the stern of the vessel 50. Each ejector winch 130 is secured to an ejection cable 134. As shown in FIGS. 11 and 13, the ejection cables 134 run over the sides of the hopper 56 and are bolted or otherwise fastened to opposite sides of the ejector blade 110. When the ejector winches 130 are driven to retrieve the cables 134, the cables 134 pull the ejector blade 110, the attached movable floor 110 and, thus, the recovered material supported by the floor 110 rearward toward the stern of the vessel 50. The only resistance to this rearward movement is the sliding friction caused by contact of the recovered material and the side walls of the hopper 56 and the belt friction experienced by the idler rollers 104. Both of these frictional forces are relatively low.

As shown in FIGS. 5, 6 and 13, the return cable 136 is coupled to the rear of the ejector blade 110. When the ejector winches 130 are driven, the return winch 132 is released to pay out the return cable 134. Conversely, when it is desired to return the ejector blade 110 to the proximal end of the hopper 56, the return winch 132 is driven to retrieve the return cable 136 and, thus, pull the blade 110 and the movable floor 100 in a forward direction (i.e., toward the bow). During this forward movement, the ejector winches 130 are, of course, released to pay out the ejector cables 134.

Although the winch system described above is preferably used to eject recovered material from the hopper 56, persons of ordinary skill in the art will readily appreciate that other drive mechanisms such as, by way of examples, not limitations, chain drive systems and/or hydraulic cylinders could be used in this role without departing from the scope or spirit of the invention. Similarly, although the winches 130, 132 could be powered in many different, well known ways without departing from the scope or the spirit of the invention (e.g., electric motors), in the disclosed vessel 50 the winches 130, 132 are powered by hydrostatic motors.

For the purpose of discharging the recovered material from the hopper 56, the material transportation vessel 50 is further provided with an auger 140. As shown in FIGS. 5–7, the auger 140 is mounted across the stern of the vessel 50. As also shown in those figures, the auger 140 is mounted in a track system for sideways movement between an auger storage position (illustratively, the position shown in solid lines in FIG. 5), and an auger extended position (illustratively, the position shown in dotted lines in FIG. 5 (see also FIG. 23). The auger 140 is preferably positioned in the auger storage position when the hopper 56 of the material transportation vessel 50 is being filled and is preferably positioned in the auger extended position when the hopper 56 is being emptied. When the auger 140 is in the auger extended position, the auger 140 extends beyond the side of the hull 52 to facilitate transporting the recovered material out of the hopper 56 and off of the vessel 50. Preferably, the auger 140 projects about 2 meters past the hull 52.

As shown in FIGS. 5, 6, 7 and 23, the auger is provided with a housing 142 that covers virtually the entire length of the auger blade 144. However, the proximal end of the auger housing 142 defines an opening 146 that exposes the auger blade 144. The opening 146 is sized to be at least as wide as the hopper 56 and is located such that, when the auger 140 is extended to the auger extended position, the opening 146 is aligned with the hopper 56 so that advancement of the floor 100 and ejector blade 110 can feed recovered material from the hopper 56 to the auger blade 144. As shown in FIG. 5, when the auger 140 is in the auger storage position, the opening 146 is displaced from the hopper 56 and a side of the auger housing 142 forms the proximal side of the hopper 56.

As mentioned above, the auger 140 is preferably mounted on a track. Although persons of ordinary skill in the art will readily appreciate that many different track systems can be used in this role without departing from the scope or the spirit of the invention, in the illustrated vessel 50, the track system comprises wheels mounted on the auger 140 and running in tracks mounted on the deck of the vessel 50 similar to those employed with the ejector blade 110. Similarly, although persons of ordinary skill in the art will appreciate that many different types of drive systems can be implemented to move the auger between the storage and extended positions, in the illustrated vessel 50 the auger 140 is reciprocated between these positions by hydraulic cylinders (not shown). Additionally, although it will further be appreciated that the auger blade 144 can be powered in any of a number of conventional ways (e.g., an electric motor), in the illustrated vessel 50 the auger blade 144 is driven by a hydrostatic motor through a chain drive assembly. Preferably, the auger blade 144 drive system is mounted within the auger housing 142 and moves with the auger 140 between the retracted and extended positions.

In order to ensure the recovered material is efficiently discharged from the hopper 56, the rate at which the floor 100 and ejector blade 110 feed the recovered material is preferably substantially matched to the rate at which the auger blade 144 removes the fed material from the hopper 56. Although persons of ordinary skill in the art will readily appreciate that such rate matching can be accomplished in many ways without departing from the scope or spirit of the invention, in the disclosed vessel 50 this rate matching is achieved automatically by tying the speed of the hydrostatic motor driving the auger blade 144 to the speed of the hydrostatic motors driving the ejector winches 130. Although such automatic control is presently preferred, persons of ordinary skill in the art will readily appreciate that the speeds of operation of the auger blade 144 and the ejector winches 130 could be independently controlled (i.e., manual rate matching of the auger feeding process) without departing from the scope or spirit of the invention.

Figure 17:
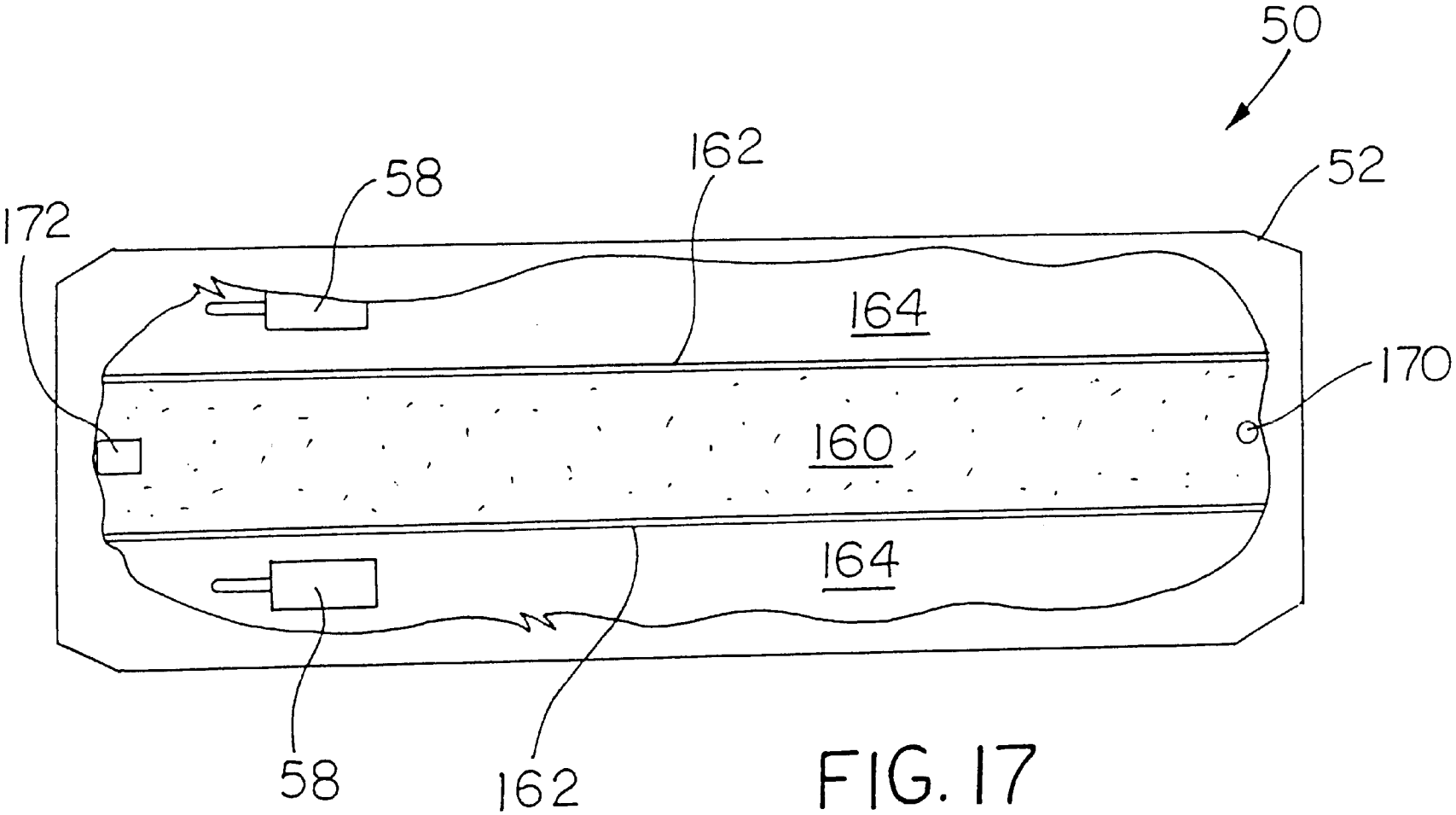
FIG. 17 is a top, cut-away view of the vessel of FIG. 5 showing the compartmentalization of the hull.

Persons of ordinary skill in the art will appreciate that, during use, the movable floor 100 of the material transportation vessel 50 will tend to become soiled. In addition, during emptying of the hopper 56, the revolving floor 100 and its cleats 104 will tend to carry a relatively small amount of recovered material below the floor 100. To address this issue, the hull 52 of the vessel 50 is preferably provided with a collection chamber 160. As shown in FIG.17, the collection chamber 160 is disposed beneath the movable floor 110 of the hopper 56 and preferably extends the length of the hull 52. Water-tight retaining walls 162 are positioned on either side of the collection chamber 160 and serve to form a water seal between the collection chamber 160 and two opposed main pontoons 164. The collection chamber 160 is open to the top so that the belt 102 of the movable floor 100 is directly exposed to the chamber 160.

As shown in FIGS. 11 and 17, the collection chamber 160 is further provided with a collection port 170 for selectively accepting water into the collection chamber 160, an exit port (not shown) for selectively removing water and/or debris from the collection chamber 160, and a pump 172 mounted within the exit port for discharging water and/or debris from the chamber 160 out of the exit port. When it is desired to clean the belt 102 of the floor 100 and/or to remove the debris collected in the collection chamber 160, the operator opens the cleaning port 170 while driving the vessel 50 forward to blast water into the collection chamber 160. The pump 172 is subsequently activated to pump the water and debris from the collection chamber 160. When the cleaning process is complete, the collection port 170 is closed. Of course, the area of the belt 102 that is exposed to the recovered material is the area that will become soiled most frequently. Therefore, the cleaning operation will typically be performed with the blade 110 in its rearmost position (i.e., with the most soiled part of the belt 102 positioned adjacent the collection chamber 160 for cleaning).

Preferably, the volume of the collection chamber 160 is significantly smaller than the volume of the main pontoons 164. As will be appreciated by persons of ordinary skill in the art, each of the main pontoons 164 should be provided with its own bilge pump (not shown). As shown in FIG. 17, the engines 58 are located in the main pontoons 164.

In order to facilitate loading and off loading of the material transportation vessel 50, the vessel 50 is provided with automatic couplers 180. As shown in FIGS. 5–7 in the illustrated vessel 50, the automatic couplers 180 are each implemented by (1) a capture arm 182 which is pivotally mounted to the deck of the vessel through a conventional hinge and (2) a pin mounted on another structure. Each capture arm 182 defines a bore 184 which is sized to receive a vertically positioned, tapered pin mounted on an adjacent structure such as a vessel. Preferably the pins captured by the capture arms 182 are sized to permit the capture arms 182 to move vertically relative to the pins as the vessel 50 is loaded or unloaded to accommodate changes in draft caused by such processes.

Figure 20:
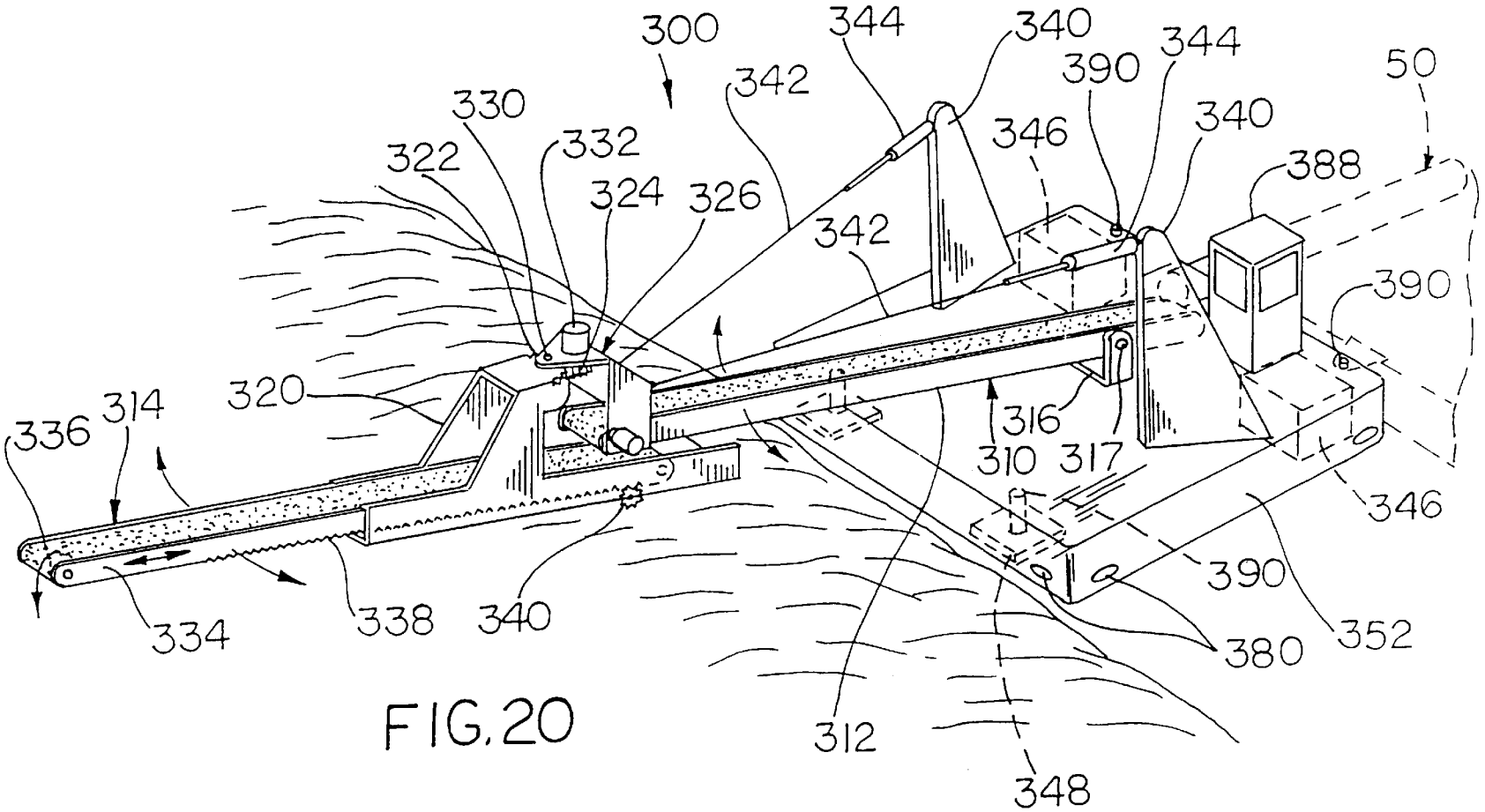
FIG. 20 is a left, front perspective view of a material distribution vessel constructed in accordance with the teachings of the invention.
Figure 21:
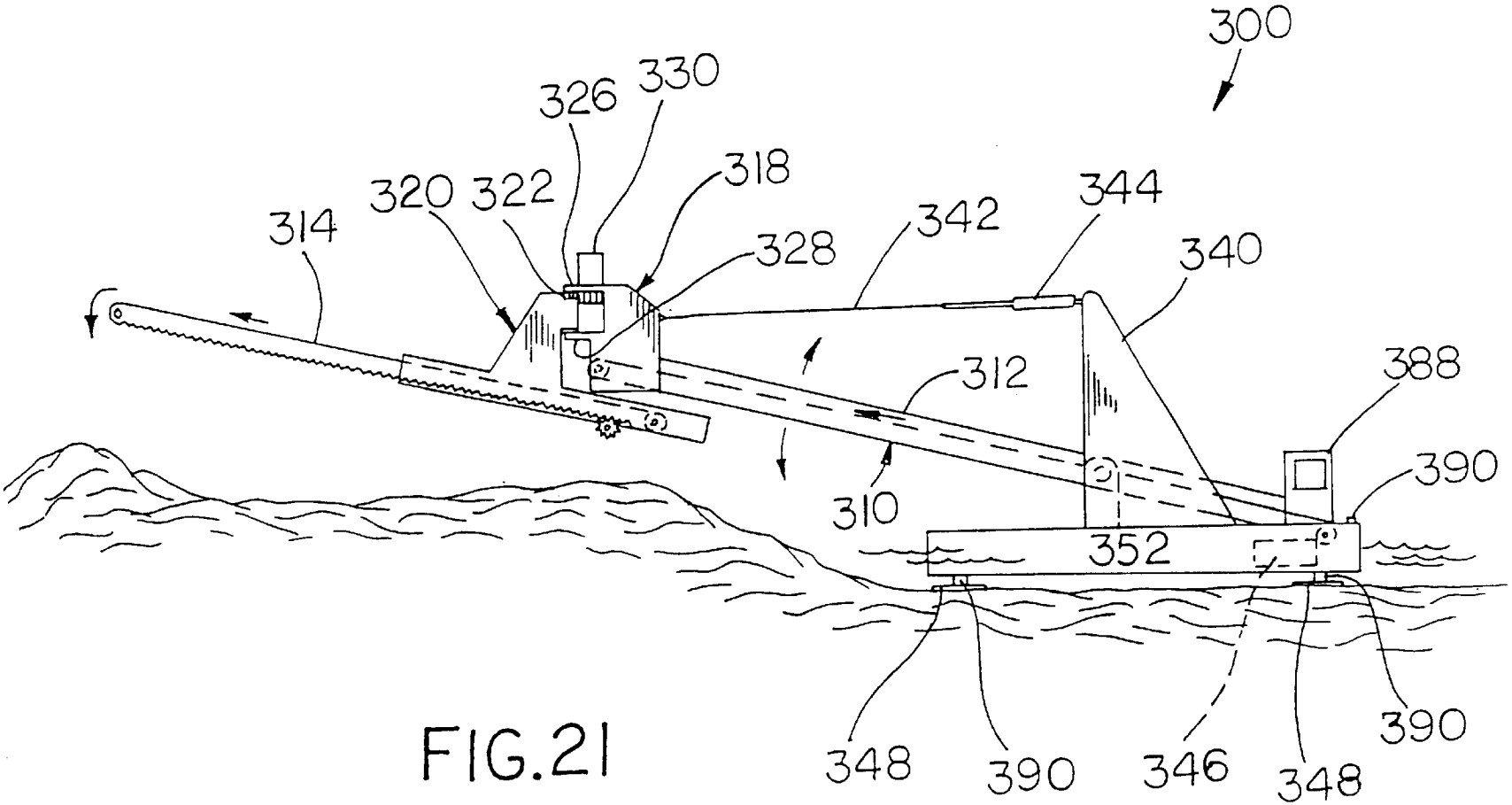
FIG. 21 is a left, side view of the vessel of FIG. 20 showing the distribution conveyor in its extended position.
Figure 22:
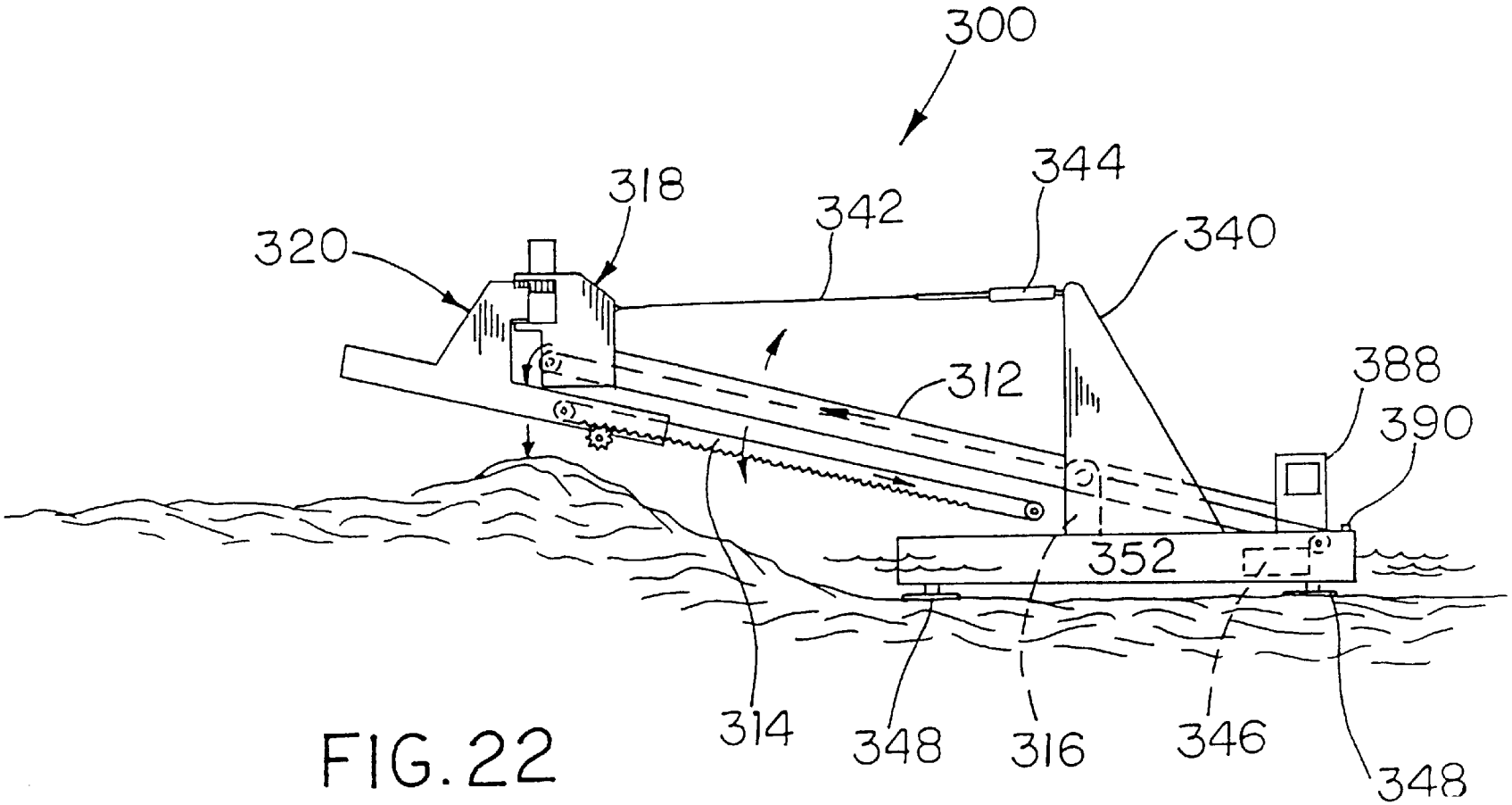
FIG. 22 is a view similar to FIG. 21, but showing the distribution conveyor in the retracted position.

As mentioned above, the material transportation vessel 50 is particularly adapted to transport recovered material from a dredging vessel such as the vessel 10 shown in FIG. 2 to a material distribution vessel such as the vessel 300 shown in FIGS. 20–21. Preferably, the automatic couplers 180 of the material transportation vessel 50 are designed to cooperate with both the dredging vessel 10 and the material distribution vessel 300. Therefore, if the material transportation vessel 50 is provided with capture arms 180, the dredging vessel 10 and the material distribution vessel 300 are both provided with mating pins. Conversely, if the transportation vessel 50 includes pins, the dredging vessel 10 and the material distribution vessel 300 include capture arms 180. In the example shown in FIGS. 15 and 16, the dredging vessel 10 is provided with the capture arms 180 and the transportation vessel 50 is provided with the vertical pins 190.

Regardless of the arrangement of the arms 182 and pins 190, the couplers 180 are preferably operated automatically. In particular, each capture arm 182 is provided with a small hydraulic (or, alternatively, an air) cylinder (not shown) that pivots the corresponding arm between a stored position (shown in solid lines in the upper left corner of FIG. 5) and a capture position (shown in dotted lines in that same figure). Automatic operation enables an operator in the cab 88 to dock the vessel 50 without assistance from a crew member.

To facilitate docking the material transportation vessel 50 to the dredging vessel 10 and/or the material distribution vessel 300, the transportation vessel 50 and/or the dredging vessel 10 and the material distribution vessel 300 are provided with bumpers 194. Although persons of ordinary skill in the art will readily appreciate that the bumpers 194 can be implemented in many ways without departing from the scope or spirit of the invention, in the illustrated vessels 10, 50, 300, the bumpers 194 are implemented by rubber tires, either Pneumatic or solid, mounted for rotation in substantially horizontal planes and extending from the sides of the vessels 10, 50, 300. Rolling bumpers 194 are preferred because they facilitate movement of adjacent vessels 10, 50, 300.

Figure 4:
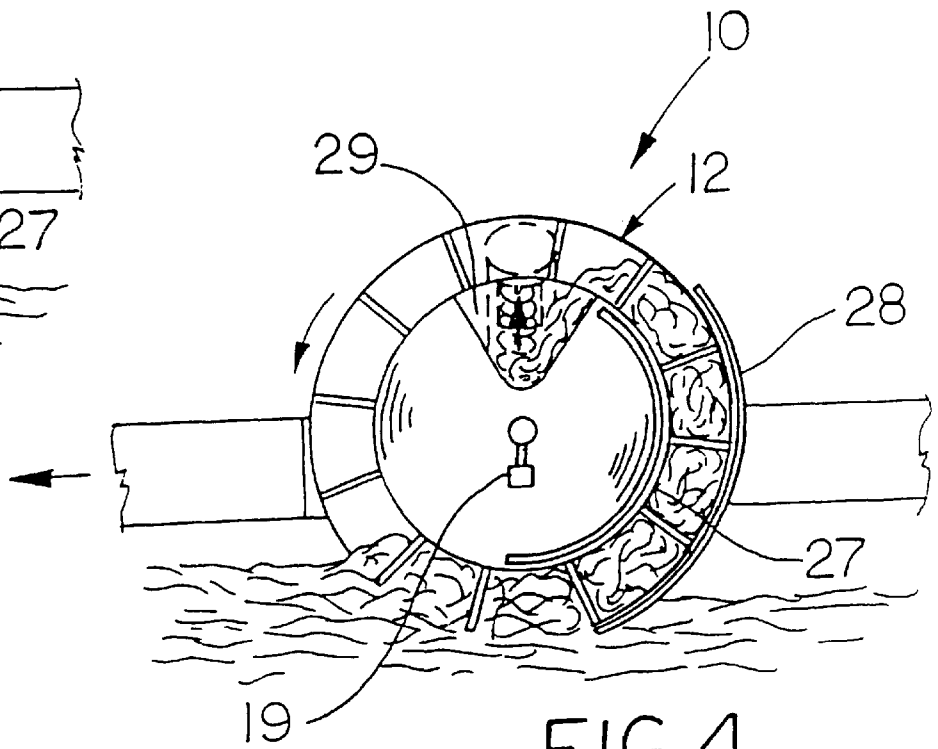
FIG. 4 is a view similar to FIG. 3, but showing the dredging wheel in a second state of operation.

While for purposes of illustration the bumpers 194 are shown on both the dredging vessel 10 of FIGS. 2–4 and the transportation vessel 50 of FIGS. 5–14, preferably only one of these vessels 10, 50 is provided with bumpers 194. If the dredging vessel 10 includes bumpers 194, the material distribution vessel 300 preferably also includes bumpers 194 and the transport vessel 50 does not. Conversely, if the transportation vessel 50 includes bumpers 194, the dredging vessel 10 and the material distribution vessel 300 do not include bumpers.

Figure 18:
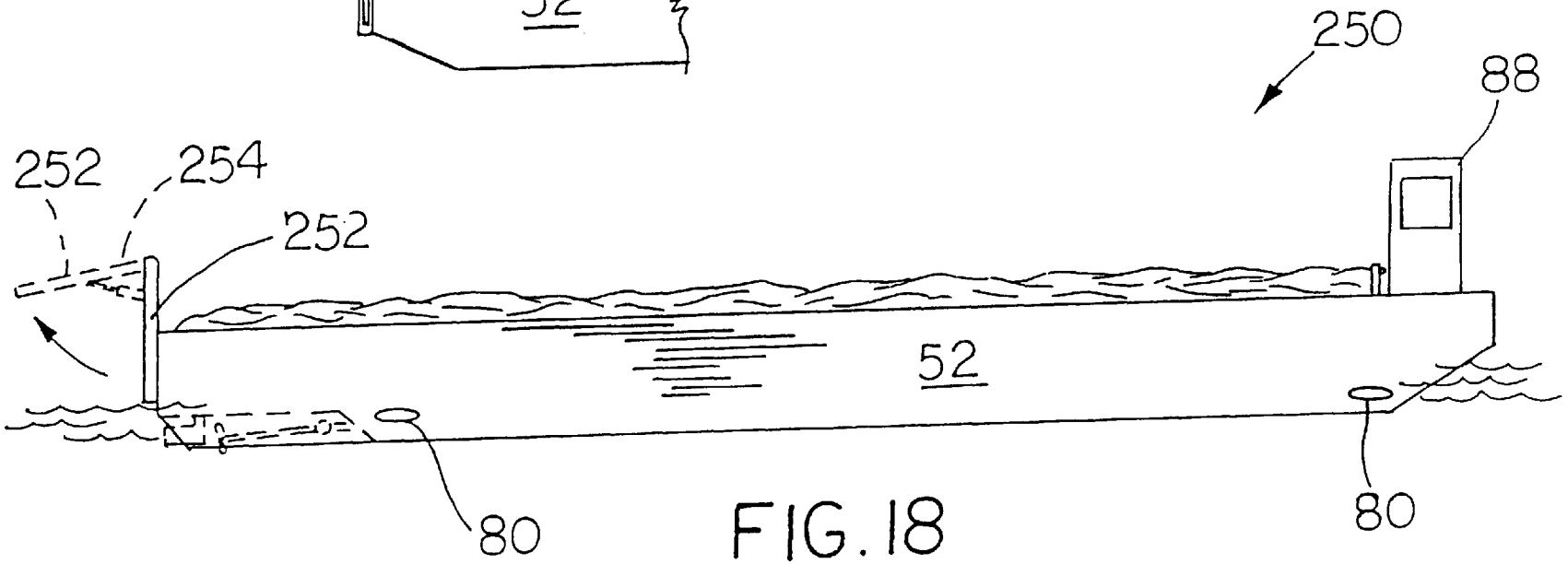
FIG. 18 is a side view of another vessel constructed in accordance with the teachings of the invention for transporting and off-loading material recovered in a dredging operation.

A material distribution vessel 350 constructed in accordance with the teachings of the invention but employing a different hopper discharge technique is shown in FIG. 18. The vessel 250 of FIG. 18 is substantially identical to the vessel 50 shown in FIGS. 5–14 except that, instead of including an auger 140, the vessel 250 is provided with a tailgate 252 which forms the proximal side of the hopper 56. As shown in FIG. 18, the tailgate 252, which preferably extends the width of the hopper 56, is movable from a storage position wherein the tailgate prevents recovered material from exiting the hopper 56, to a discharge position wherein the tailgate 252 permits discharge of the recovered material out of the hopper 56. In the vessel 250 shown in FIG. 18, the tailgate 252 is pivotally mounted and can be pivoted up and away from the vessel 50 by a hydraulic cylinder 254 when unloading of the hopper 56 is desired. With the tailgate 252 moved, the ejector blade 110 and floor 100 can simply push the recovered material out of the back of the vessel 250 to empty the hopper 56.

Figure 19:
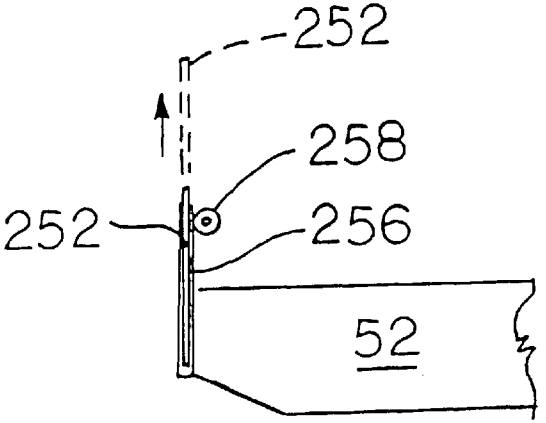
FIG. 19 is a side view of an alternative tailgate configuration for the vessel of FIG. 18.

Persons of ordinary skill in the art will appreciate that other tailgate configurations can also be used without departing from the scope or spirit of the invention. By way of examples, not limitations, the tailgate 252 can pivot downward and away from the vessel 250. Alternatively, as shown in FIG. 19, the tailgate 252 can be mounted within vertical tracks and provided with a rack 256 and a driving gear or pinion 258 that cooperates with the rack 256 to raise the tailgate 252 to the discharge position (shown in phantom lines in FIG. 19) when it is desired to empty the hopper 56.

Figure 16:
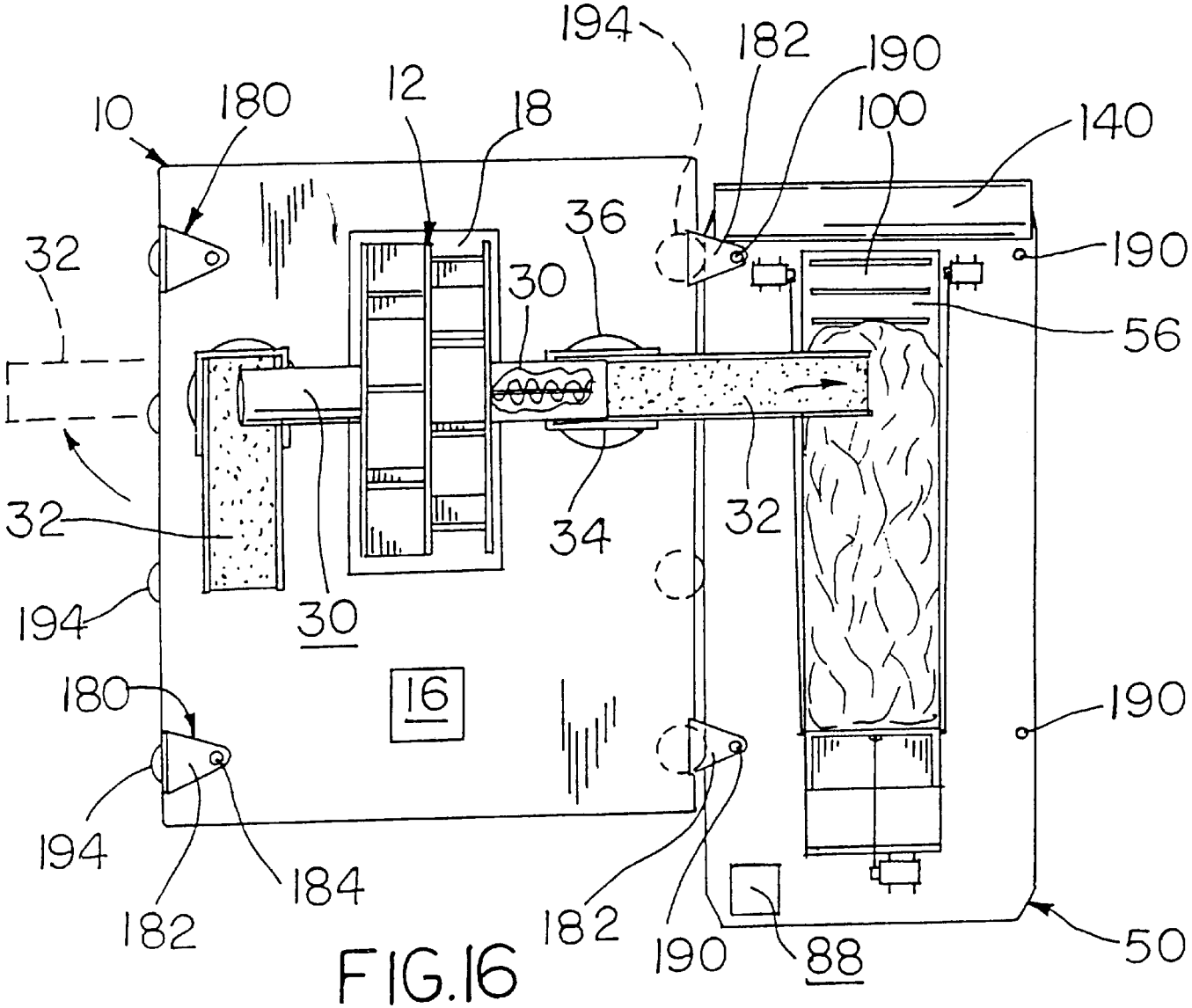
FIG. 16 is a top view of the dredging vessel of FIG. 2 loading the material transportation vessel of FIG. 5.

One possible way of loading the material transportation vessel 50 with the dredging vessel 10 is shown in FIG. 16. In this example, the automatic couplers 180 have been used to secure the transportation vessel 50 to the dredging vessel 10. The ejector blade 110 and the floor 100 are initially moved to a position wherein the ejector blade 110 is located immediately adjacent the end of a conveyor 32 of the dredging vessel 10. The auger 30 on the side of the dredging vessel 10 facing the transport vessel 50 is then run to deliver material from the hopper 29 of the dredging wheel 12 to the conveyor 32. The conveyor 32 also operates to transport the material received from the auger 30 into the hopper 56 on the stern side of the ejector blade 110. When the area of the hopper 56 beneath the conveyor 32 becomes full, the return winch 132 is actuated to retract the ejector blade 110 and the movable floor 100 by an incremental amount to position an empty area of the floor 100 beneath the conveyor 32. This process continues until dredging is complete, and/or the hopper 56 is full (i.e., ejector blade 110 has been completely retracted). In either event, the automatic couplers 180 are released and the material transportation vessel 50 departs from the dredging vessel 10 under its own power. An empty material transportation vessel 50 is then docked to the dredging vessel 10 to be loaded as explained above.

Although the dredging vessel 10 has the capacity to dock with and load a material transportation vessel 50 on either (or both) of its sides, typically, only one material transportation 50 will be loaded at a time. The material transportation vessel 50 operates on the deep water side of the dredging vessel 10. Although the illustrated dredging vessel 10 is shown with two augers 30, persons of ordinary skill in the art will appreciate that the wheel 12 can be provided with one auger 30 instead of two without departing from the scope or spirit of the invention. A single auger arrangement could be advantageous because a dual auger arrangement will typically require simultaneous removal of dredged material from both sides of the wheel 12. A single auger arrangement would off-load to the deep side of the vessel 10 at all times.

Persons of ordinary skill in the art will readily appreciate that, although the above-described method of loading the hopper 56 from the dredging vessel 10 is presently preferred, other techniques of loading the hopper 56 can be employed without departing from the scope or spirit of the invention. By way of example, not limitation, the material transportation vessel 50 can move the ejector blade 110 to its fully retracted position with the hopper 56 empty. Rather than actuating the automatic couplers 180, the material transportation vessel 50 can then move into contact with the side of the dredging vessel 10 and move slowly forward (remaining in contact with the rolling bumpers 194) as the conveyor 32 fills the hopper 56 from the end closest to the stern to the end closest to the bow. This method is not preferred, however, because of the possibility of interfering with the dredging operation by bumping the dredging vessel 10, and thus, moving it sideways, during the loading process.

Persons of ordinary skill in the art will readily appreciate that, regardless of the loading process employed, the dredging wheel 12 will preferably continue to operate during the loading process since the hopper 29 of the wheel 12 has a substantially smaller capacity than the hopper 56 of the material transport vessel.

C. Material Distribution Vessel

A material distribution vessel 300 constructed in accordance with the teachings of the invention is shown in FIG.

20. As will be discussed in greater detail below, the disclosed material distribution vessel 300 is particularly adapted for depositing material recovered in a dredging operation into a waterway to rapidly form an island or levy. Alternatively, the disclosed material distribution vessel 300 may be used to deposit recovered material directly into an onshore vehicle such as a truck or onto another material distribution center (either onshore or offshore). As will be described below, the disclosed material distribution vessel 300 is particularly adapted to cooperate with the material transportation vessel 50 discussed above.

The disclosed material distribution vessel 300 is a self-propelled, water borne vessel having two modes of operation. Specifically, in a first mode of operation (the "transport mode"), the material distribution vessel 300 floats upon a waterway to enable the vessel 300 to be propelled to a desired location. In a second mode of operation (the "distribution mode"), the material distribution vessel 300 is temporarily grounded on the bed of the waterway to provide a sturdy base for distributing material received from an adjacent structure such as the material transportation vessel 50 disclosed above.

Although the material distribution vessel 300 is particularly well suited for distributing material recovered in a dredging operation, persons of ordinary skill in the art will readily appreciate that the disclosed material distribution vessel 300 is not limited to use with any particular type of material. By way of example, not limitation, the disclosed vessel 300 can be used to distribute material gathered in an onshore operation to build an island and/or levy at a desired location in the waterway.

For the purpose of enabling the material distribution vessel 300 to operate in very shallow water, the material distribution vessel 300 is provided with a low draft hull 352. Like the material transportation vessel 50 disclosed above, the material distribution vessel 300 is provided with a propulsion system to enable the vessel 300 to move through a waterway. Although persons of ordinary skill in the art will readily appreciate that the propulsion system can be implemented in many ways without departing from the scope or spirit of the invention, in the illustrated material distribution vessel 300 the propulsion system is implemented with water jets or thrusters 380. In particular, as most easily seen in FIG. 23, the hull 352 of the material distribution vessel 300 is generally rectangular in shape, and a thruster system is located at each of the corners of the hull 352.

Figure 23:
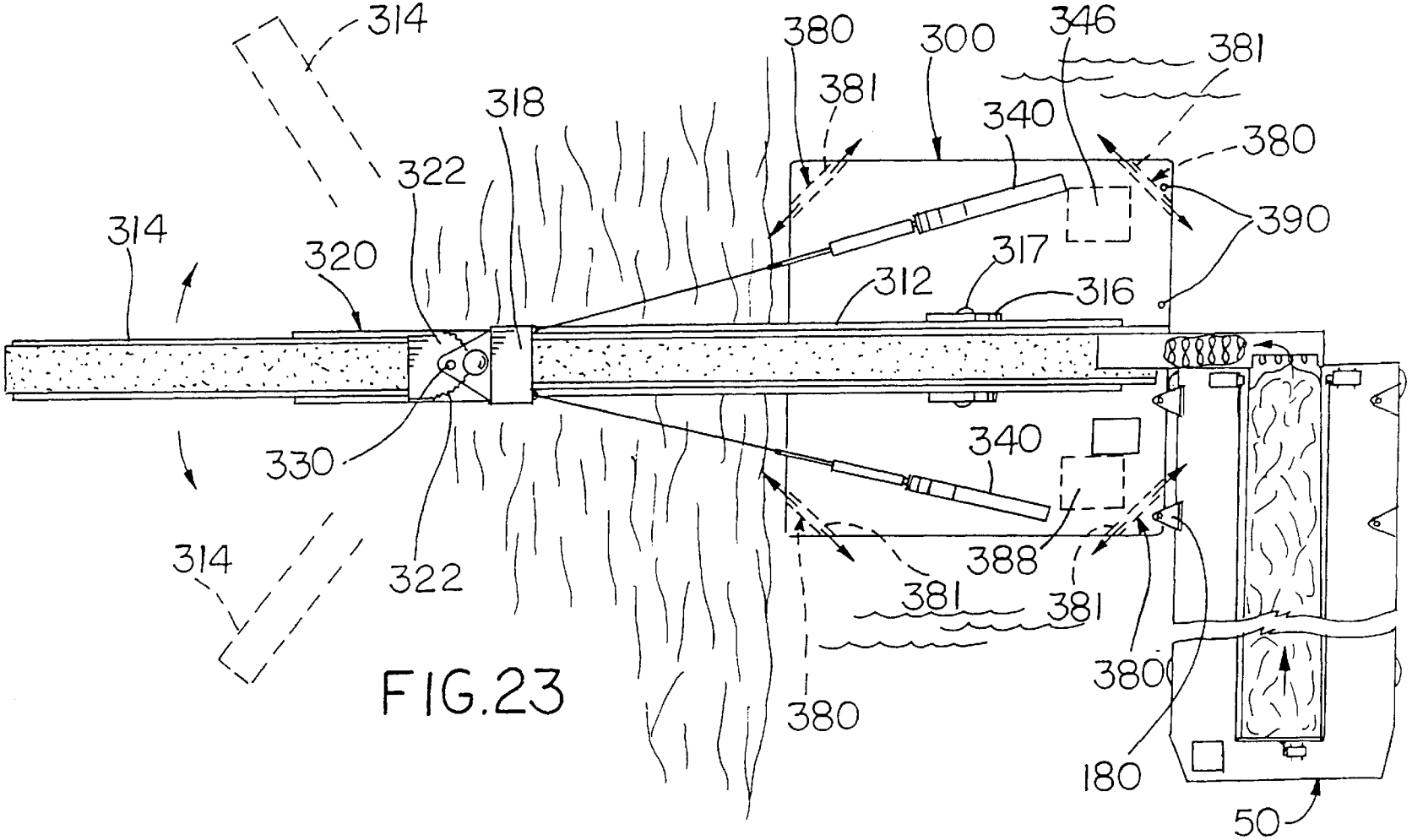
FIG. 23 is a top view of the material distribution vessel of FIG. 20 cooperating with the material transportation vessel of FIG. 5.

Each of the four thruster systems 380 includes a conduit 381, and a bi-directional impeller (not shown). The conduits 381 of the thruster systems 380 are each arranged diagonally such that one open end of the conduit 381 exhausts on a first side of the hull 352, and the second open end of the conduit exhausts on a second side of the hull 352 as shown in FIG. 23. Each thruster system 380 can thus expel a jet of water through a first side of the hull 352 by rotating its impeller in a first direction and through a second side of the hull 352 by reversing the direction of the impeller. By operating the four thruster systems 380 cooperatively, one can thus maneuver the material distribution vessel 300 in any desired direction. Preferably, the material distribution vessel 300 can completely rotate within its own length.

As with the material transportation vessel 50, the propulsion system, as well as the other systems of the vessel 300 described below are preferably operated from a control panel located in a cab 388.

Persons of ordinary skill in the art will readily appreciate that, although the disclosed vessel implements its propulsion system via the thruster systems 380 described above, other types of propulsion systems can be utilized without departing from the scope or spirit of the invention.

In order to distribute recovered material or other substances, the material distribution vessel 300 is further provided with a conveyor system 310. As shown in FIGS. 20–23, the conveyor system 310 of the disclosed material distribution vessel 300 includes two conveyors, namely, a main conveyor 312 and a distribution conveyor 314. The main conveyor 312 is generally fixed relative to the hull 352. However, the main conveyor 312 is supported on the hull in a clevis 316 via a pivot pin 317 and is, thus, vertically pivotable about the pin 317. As shown in FIG. 21, the main conveyor 312 extends at an upward angle from the stern of the vessel 300 out past the bow of the vessel 300 where it is received in a support housing 318.

As most easily seen in FIGS. 20 and 23, the distal end of the main conveyor 312 is in substantial alignment with the proximal end of the distribution conveyor 314. Thus, material loaded onto the proximal end of the main conveyor 312 will generally be carried upward through the support housing 318 to the distal end of the main conveyor 312. Upon reaching the distal end of the main conveyor 312, the conveyed material will fall onto the proximal end of the distribution conveyor 314 and immediately be conveyed forward to the distal end of that conveyor 314. When the conveyed material reaches the distal end of the distribution conveyor 314, the conveyed material will fall off of the conveyor system 310 under the influence of gravity.

In order to facilitate spreading of material conveyed by the conveyor system 310, the distribution conveyor 314 is mounted for pivoting movement with respect to the main conveyor 312. To this end, the distribution conveyor 314 is suspended beneath the distal end of the main conveyor 312 by a suspension housing 320. As shown in FIG. 20, the proximal end of the suspension housing 320 forms an arcuate rack 322 which meshes with a gear 324 suspended from the support housing 318. As most easily seen in FIG. 21, the proximal end of the suspension housing 320 is captured between an upper plate 326 and a lower plate 328 of the support housing 318 which together form a clevis. A pin 330 passes through the upper and lower plates 326, 328 and the proximal portion of the suspension housing 320 to secure the suspension housing 320 to the support housing 318. A motor 332 mounted above the upper support plate 326 is coupled to the gear 324. The motor 332, which may be implemented by an electric or hydrostatic motor, can be actuated to drive the gear 324, which responds by interacting with the arcuate rack 322 to cause the suspension housing 320 to pivot about the pin 330. The motor 332 is controlled from the cab 388 to slew the distribution conveyor 314 through an arcuate path of approximately 180° (see FIG. 23).

In order to further facilitate distribution of the recovered material carried by the conveyor system 310, the distribution conveyor 314 is longitudinally movable within the suspension housing 320. In particular, the distribution conveyor 314 is movable between an extended position (illustratively, the position shown in FIG. 21) and a retracted position (illustratively, the position shown in FIG. 22). When the distribution conveyor 314 is in its extended position, the material conveyed by the conveyor system 310 will fall somewhere along an are defined by the distal tip of the distribution conveyor 314. When the distribution conveyor 314 is in its retracted position, the conveyed material will fall off of the main conveyor 312 directly down without contacting the distribution conveyor 314.

In the illustrated vessel 300, the distribution conveyor 314 is rendered longitudinally movable with respect to the suspension housing 320 by a rack and pinion system. In particular, the suspension conveyor 314 includes a frame 334 and a conveyor belt 336. The underside of the frame 334 is provided with a linear rack of teeth 338. A gear 340 is rotatably mounted below the suspension housing 320 in meshing engagement with the linear rack 338. The gear 340 is coupled to a drive motor (not shown). The drive motor, (which can be implemented by a hydrostatic or electrostatic motor of conventional design), can be actuated from controls in the cab 388 to rotate the gear 340 to cause the rack 338 to move in a desired direction to thereby extend or retract the frame 334 and, thus, the distribution conveyor 314.

Although persons of ordinary skill in the art will readily appreciate that the conveyors 312, 314 can be implemented in many ways without departing from the scope or spirit of the invention, in the illustrated vessel 300 both the main conveyor 312 and the distribution conveyor 314 are implemented by commercially available belting material such as steel or nylon reinforced rubber wrapped in endless loop fashion around a frame comprising side plates and a plurality of idler gears. Similarly, although persons of ordinary skill in the art will readily appreciate that the conveyors 312, 314 could be driven in many ways without departing from the scope or spirit of the invention, in the illustrated vessel 300 the conveyors 312, 314 are driven by electrostatic or hydrostatic motors in a conventional fashion.

In order to support the suspension housing 320 and the support housing 318, the material distribution vessel 300 is further provided with a pair of stanchions 340. As shown in FIG. 20 the stanchions 340 are mounted on opposite sides of the deck of the vessel 300. A support cable 342 is attached between each of the stanchions 340 and the proximal end of the support housing 318. For the purpose of rendering the lengths of the cables 342 adjustable, each of the cables 342 is coupled to its respective stanchion 340 through a hydraulic cylinder 344. As mentioned above, the main conveyor 312 is pivotally mounted to the hull 352 via a clevis 316 and a pivot pin 317. The distal end of the main conveyor 312 is journalled in the support housing 318. Therefore, the main conveyor 312 can be pivoted about its pivot pin 317 by extending or retracting the hydraulic cylinders 344. Because the distribution conveyor 314 is mounted in a plane that is fixed parallel to the main conveyor 312, adjusting the pitch of the main conveyor 312 will similarly adjust the pitch of the distribution conveyor 314.

Persons of ordinary skill in the art will appreciate that, in order to facilitate movement under bridges and the like, the vessel 300 preferably has a low profile.

As will be appreciated by persons of ordinary skill in the art, when loaded with material, the conveyor system 310 will apply a substantial moment to the hull 352 of the material distribution vessel 300. Therefore, to ensure the vessel 300 provides a stable base for distributing material, the hull 352 is provided with ballast tanks 346 near its stern (i.e., opposite the distal end of the main conveyor 312). These ballast tanks 346 are serviced by pumps (not shown) that are controlled to selectively pump water from the waterway into the tanks 346 to provide mass counteracting the large moment present during the distribution operation of the vessel 300. To further ensure that the material distribution vessel 300 provides a sturdy base for the distribution operation, the vessel 300 is further provided with support pads/stabilizer jacks 348 which are mounted to the bottom of the hull at each of its corners. The support pads 348 are implemented by large plates suspended from hydraulic cylinders 390. Each of the cylinders 390 is independently operable to enable leveling of the hull 352 on an uneven waterway bed. When the vessel 300 is to perform a distribution operation, the hydraulic cylinders 390 are each extended until their corresponding pads 348 contact the bottom of the waterway as shown in FIG. 21. The engagement between the bed of the waterway and the support pads/stabilizer jacks 348 lifts the hull 352 such that it is no longer floating to ensure that the hull 352 provides a stable work base during the distribution operation. When the distribution operation is completed and it is desired to move the vessel 300 to a new location, the stabilizer jacks 348 are raised, and the ballast tanks 346 are evacuated such that the material distribution vessel 300 can be transported to a new location under the force of its propulsion system. To provide the vessel 300 with enhanced stability during transportation, the distribution conveyor 314 is preferably moved to its retracted position during movement of the vessel 300.

As mentioned above, the material distribution vessel 300 is particularly adapted to cooperate with the material transportation vessel 50 discussed above. In particular, the material distribution vessel 300 is provided with docking pins 390 such as those discussed above. These docking pins 390 are adapted to cooperate with the capture arms 182 of the transportation vessel 50 to secure the vessels 50, 300 together during the distribution operation.

In particular, the material transportation vessel 50 cooperates with the 40 material distribution vessel 300 in the following manner. The loaded material transportation vessel 50 pulls along side the stern of the material distribution vessel 300. The rolling bumpers 194 operate to permit relative movement between the vessels 50, 300 during the docking operation. Once the vessels 50, 300 are aligned, the automatic couplers 380 are actuated to secure the vessels 50, 300 together. The auger 140 is then moved to its extended position (see FIG. 23) such that the discharge opening of the auger 140 is suspended above the proximal end of the main conveyor 312. The auger blade 144, the ejector blade 110 and the movable floor 100 of the transportation vessel 50 are then actuated to begin discharging the recovered material from the hopper 56. The conveyors 312, 314 of the material distribution vessel 300 are also actuated. The auger 140 of the transportation vessel 50 then deposits material from the hopper 56 onto the main conveyor 312. The main conveyor 312 carries the deposited material forward to the distribution conveyor 314 which, in turn, carries the material forward and drops it off of its distal end. The distribution conveyor 314 can be extended, retracted and/or slewed to deposit the material in desired location(s).

Figure 28:
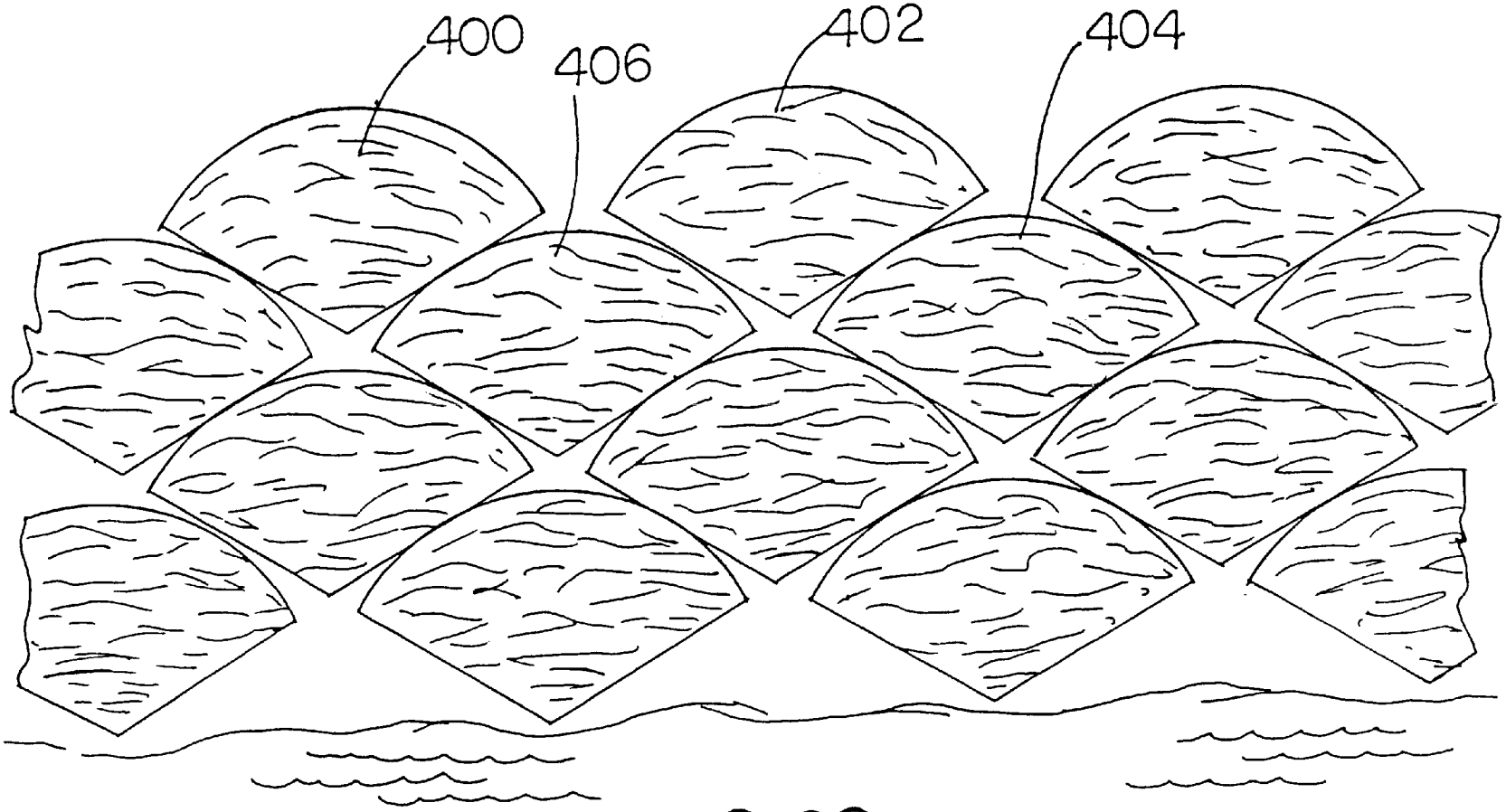
FIG. 28 is a top view of an exemplary island or levy constructed with the material distribution vessel of FIG. 20.

In an operation to create an island in a waterway from the recovered material, the distribution conveyor 314 is preferably initially positioned in a fully extended and fully slewed position. As material is conveyed by the conveyor system 310, the distribution conveyor 314 is slowly slewed to deposit an arcuate pile of material in the waterway to a desired height. After the distribution conveyor 314 has been completely slewed through one complete stroke, the distribution conveyor 314 is partially retracted to allow formation of a second arcuate pile at a smaller radius from the first arcuate pile. The distribution conveyor 314 is then slewed through another stroke as it deposits material into the waterway. Upon completion of the second arcuate pile, the distribution conveyor 314 is again retracted to initiate another slew stroke. This process continues until the distribution conveyor 314 reaches its fully retracted position. At this point, an entire island building area 400 (see FIG. 28) will have been completed.

If the island is to comprise more than one island building area 400, the ballast tanks 346 are emptied by their pumps, the stabilizer feet 348 are retracted and the island distribution vessel 300 is moved to a second island building area 402 using its propulsion system. Upon reaching the desired location, the ballast talks 346 are again filled, the stabilizer feet 348 are extended, and the distribution conveyor 314 is extended. A material transportation vessel 50 can then be coupled to the material distribution vessel 300 and the island building process repeated to create another island building area 402.

If the island is to be wider than one island building area 400, after a first series of adjacent island building areas are completed for the intended length of the island, the material distribution vessel 300 is moved out away from the newly created island and a second row of island building areas 404, 406 is created adjacent the first row of island building areas 400, 402. The vessel 300 can be used to create as many island building areas (adjacent or non-contiguous) as desired. Once an island of the general desired shape is created, bulldozers can be used to shape and level the island. If desired, trees and/or other vegetation can be planted on the newly formed island.

Figure 24:
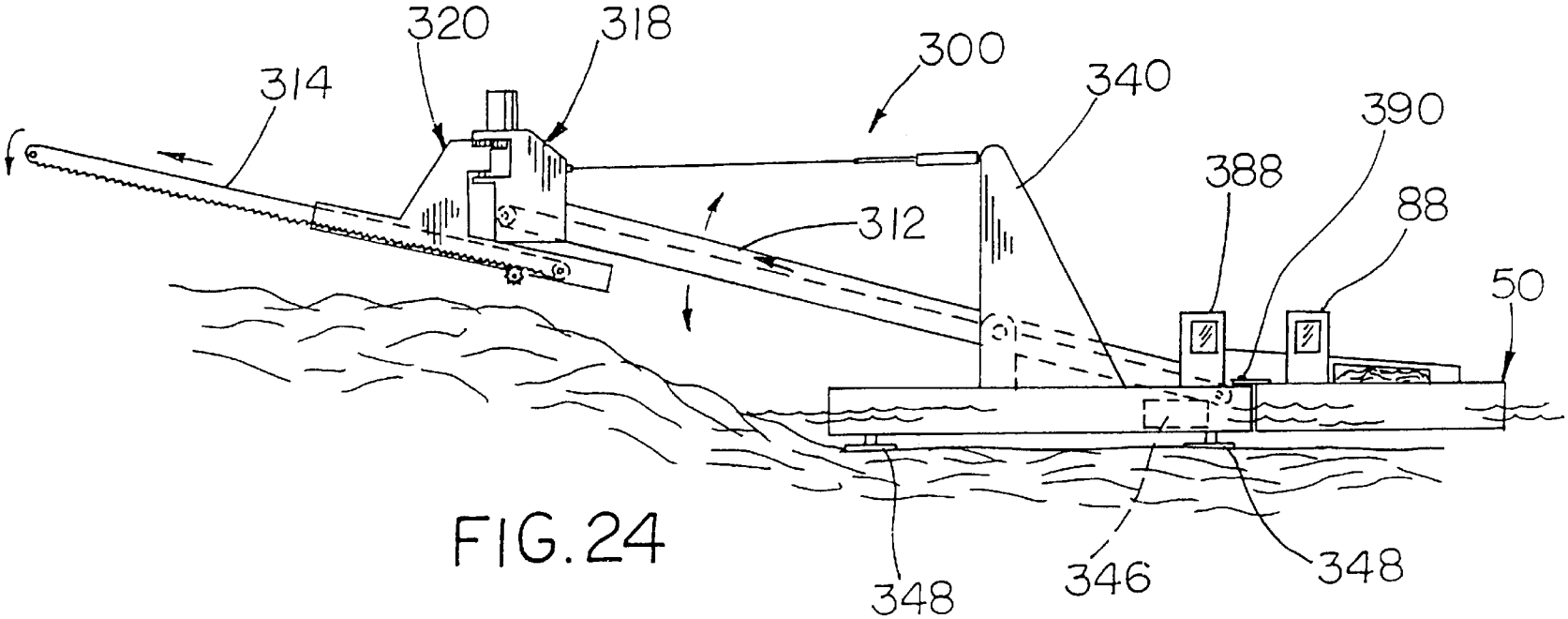
FIG. 24 is a side view of the material distribution vessel of FIG. 20 cooperating with the material transportation vessel of FIG. 5.
Figure 25:
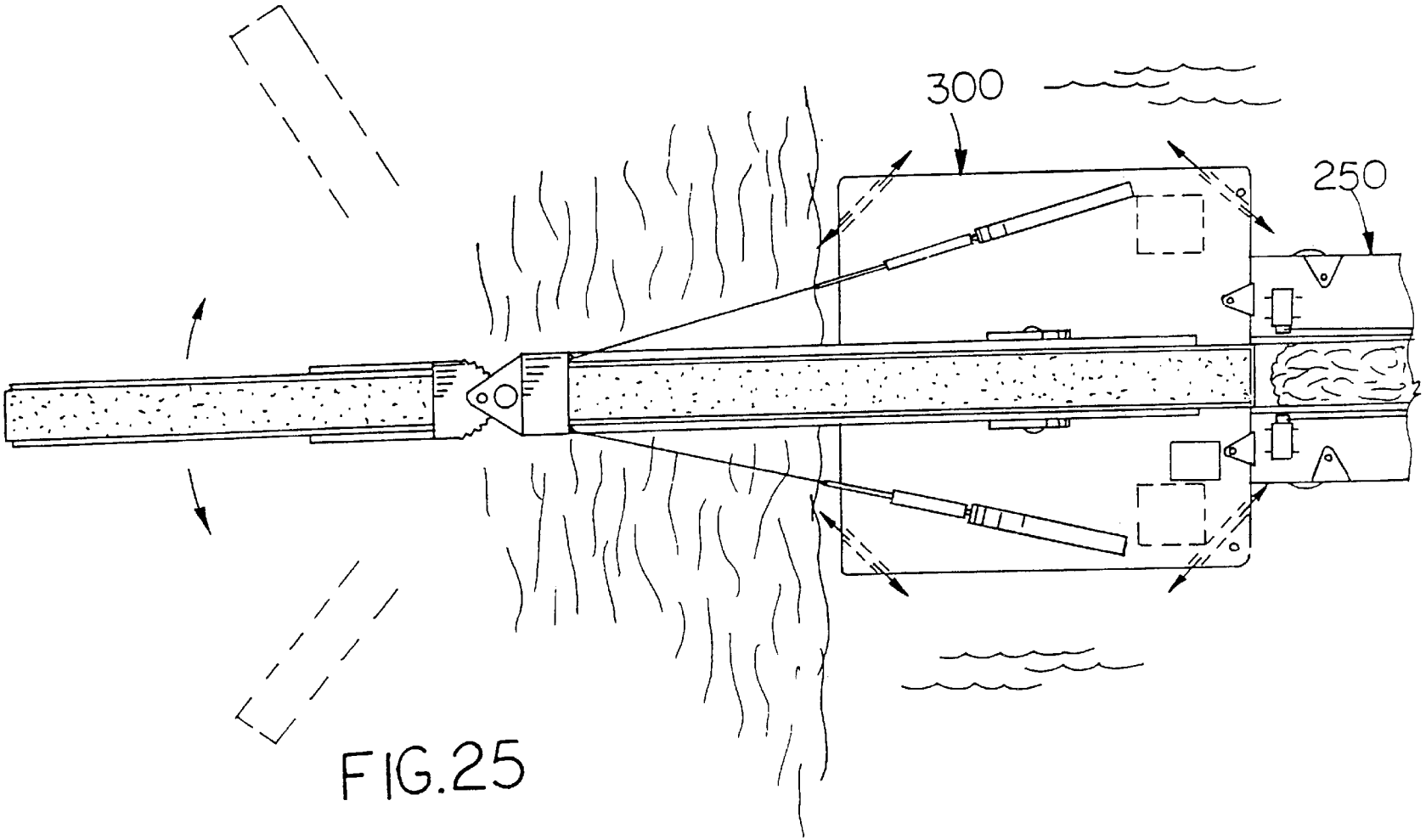
FIG. 25 is a top view of the material distribution vessel of FIG. 20 cooperating with the material transportation vessel of FIG. 15.
Figure 26:
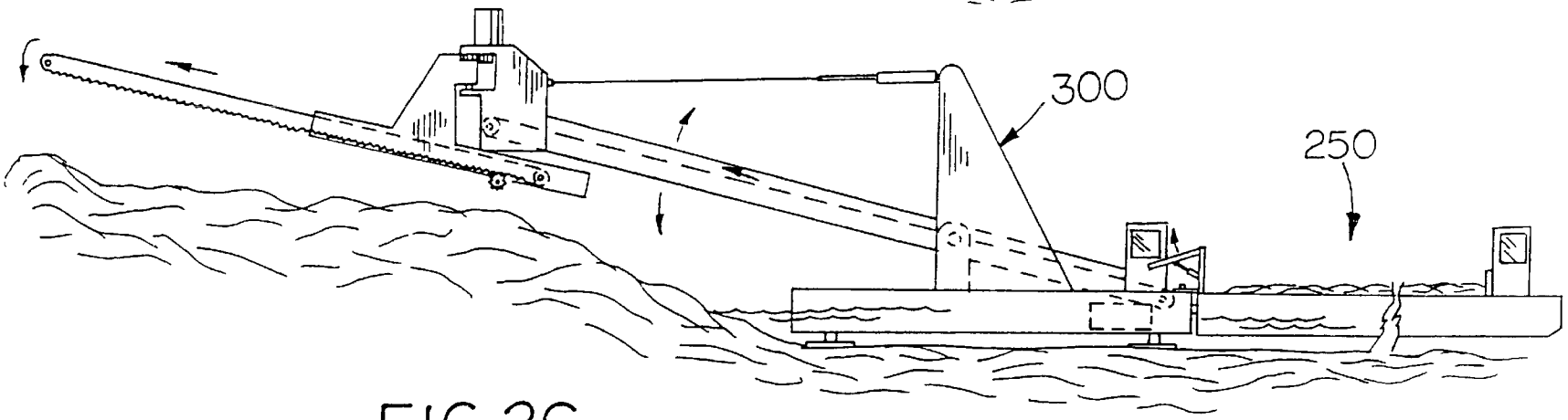
FIG. 26 is a side view of the material distribution vessel of FIG. 20 cooperating with the material transportation vessel of FIG. 15.

The material distribution vessel 300 is adapted for use with any of the material transportation vessels 50, 250 discussed above. Use of the material distribution vessel 300 with the material transportation vessel 50 is illustrated in FIGS. 23 and 24. Use of the material distribution vessel 300 with the material transportation vessel 250 shown in FIG. 18 is illustrated in FIGS. 25 and 26. In the later example, capture arms 182 are located on the stern of the transportation vessel 250 to secure the vessels 50, 300 together during a distribution operation.

Figure 27:
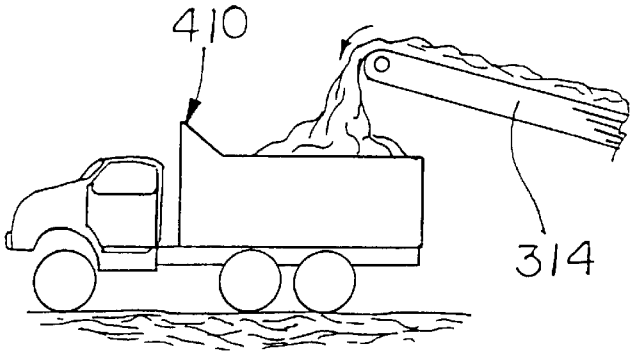
FIG. 27 is a partial side view showing the material distribution vessel of FIG. 20 loading an onshore vehicle.

Although the above description focused on employing the material distribution vessel 300 to deposit the recovered material within a waterway to create an island or levy, persons of ordinary skill in the art will readily appreciate that the teachings of the invention are in no way limited to island or levy building. On the contrary, the material distribution vessel 300 could be used in other ways without departing from the scope or spirit of the invention. For example, the distribution conveyor 314 can be used to deliver the recovered material to an onshore station such as a truck 410 as shown in FIG. 27 without departing from the scope or spirit of the invention.

From the foregoing, persons of ordinary skill in the art will readily appreciate that a new method of dredging a waterway has been provided. In particular, in the disclosed method, a dredging vessel such as the vessel 10 shown in FIG. 2 is used to dredge recovered material from a waterway in a first location. The recovered material is loaded from the dredging vessel 10 into a material transportation vessel 50, 250, which transports the material to a material distribution vessel 300 at another location in the waterway. The recovered material is then transferred from the material transportation vessel 50, 250 to the conveyor system 310 of the material distribution vessel 300. The conveyor system 310 is then controlled to deposit the recovered material from the conveyor system 310 into the waterway (or alternatively to an onshore location) at another location.

Persons of ordinary skill in the art will readily appreciate that the material distribution operation of the material distribution vessel 300 may be controlled either manually or automatically without departing from the scope or spirit of the invention. In one preferred implementation, the material distribution vessel 300 is adapted to cooperate with the global positioning satellite system (GPS) to locate and construct an island at a predetermined location. Under such an approach, the slewing, extension and retraction of the distribution conveyor 314 is completely automated to locate an island at a predetermined location with great accuracy. To facilitate automated operation, the slewing speed of the distribution conveyor 314 is preferably tied to the rotational speed of the conveyor belts. Optionally, load sensors (not shown) can be located beneath one or more of the conveyor belts to provide feedback information as to how much material is being deposited by the distribution conveyor 314 at any given time and location.

Persons of ordinary skill in the art will further appreciate that the disclosed material distribution vessel can be advantageously used to create levies in an emergency flooding situation. Under such circumstances, the dredging vessel 10 together with a material transportation vessel 50 and a distribution vessel 300 can cooperate to quickly construct a levy using on-site materials, namely, materials dredged from the bottom of the waterway threatening to flood. In view of the large volumes of material that can be quickly moved by the cooperating vessels 10, 50, 250 and/or 300, levies can be constructed in a very short time frame to address a potentially dangerous situation.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. A method of constructing an island in a waterway with material recovered in a dredging operation comprising the steps of:

positioning a material distribution vessel at a first island building area in a waterway, the material distribution vessel including a conveyor system;

supplying the conveyor system of the material distribution vessel with recovered material, the conveyor system comprising a first conveyor and a second conveyor pivotably coupled to the first conveyor;

depositing the recovered material from the second conveyor of the conveyor system into the waterway at a first location in the waterway;

moving at least the second conveyor of the conveyor system by at least one of slewing, retracting and extending the second conveyor relative to the first conveyor of the conveyor system; and depositing the recovered material from the second conveyor of the conveyor system into the waterway at a second location in the waterway, wherein the first and second locations are located within the first island building area.

2. A method as defined in claim 1 further comprising the steps of:

moving the material distribution vessel to a second island building area in the waterway.

3. A method as defined in claim 2 wherein the second island building area is adjacent the first island building area.

4. A method as defined in claim 3 further comprising the step of depositing the recovered material within the second island building area, wherein the recovered material deposited in the first and second island building areas together form a single island.

5. A method as defined in claim 4 wherein the single island is a levy.

6. A method as defined in claim 1 wherein the step of positioning a material distribution vessel at a first island building area in a waterway further comprises the step of lowering support pads into contact with a bottom of the waterway to support the material distribution vessel.

7. A method as defined in claim 1 wherein the deposited recovered material forms a levy.

8. A material distribution vessel for distributing material recovered in a dredging operation comprising:

a hull;

a propulsion system for selectively moving the hull through a waterway;

a conveyor system supported by the hull, the conveyor system having a first end for receiving recovered material and a second end for depositing the recovered material, at least a portion of the conveyor system being movable relative to the hull to move the second end to a desired position, wherein the conveyor system includes a first conveyor including the first end and a second conveyor including the second end, the first and second conveyors cooperate to move the recovered material from the first end to the second end, the second conveyor comprises the at least a portion of the conveyor system, and the second conveyor is pivotably coupled to the first conveyor via a pivot pin; and at least one support pad, the at least one support pad being movable in at least a vertical direction to support the hull on a bottom of the waterway.

9. A material distribution vessel for distributing material recovered in a dredging operation comprising:

a hull;

a propulsion system for selectively moving the hull through a waterway; and a conveyor system supported by the hull, the conveyor system having a first end for receiving recovered material and a second end for depositing the recovered material, at least a portion of the conveyor system being movable relative to the hull to move the second end to a desired position, wherein the conveyor system includes a first conveyor including the first end and a second conveyor including the second end, the first and second conveyors cooperate to move the recovered material from the first end to the second end, the second conveyor comprises the at least a portion of the conveyor system, and the second conveyor is mounted within a track to permit controlled longitudinal movement of the second conveyor relative to the first conveyor.

10. A material distribution vessel for distributing material recovered in a dredging operation comprising:

a hull;

a propulsion system for selectively moving the hull through a waterway;

a conveyor system supported by the hull, the conveyor system having a first end for receiving recovered material and a second end for depositing the recovered material, at least a portion of the conveyor system being movable relative to the hull to move the second end to a desired position; and at least one support pad, the at least one support pad being movable in at least a vertical direction to support the hull on a bottom of the waterway, wherein the second conveyor is mounted within a track to permit controlled longitudinal movement of the second conveyor and the track is pivotably coupled to the first conveyor.

* * * * *